US009014610B2

(12) United States Patent
Murakami

(10) Patent No.: US 9,014,610 B2
(45) Date of Patent: Apr. 21, 2015

(54) FUSION DEVICE AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/018,920

(22) Filed: Sep. 5, 2013

(65) Prior Publication Data

US 2014/0072356 A1 Mar. 13, 2014

(30) Foreign Application Priority Data

Sep. 7, 2012 (JP) ..... 2012-196829

(51) Int. Cl.
*G03G 15/20* (2006.01)

(52) U.S. Cl.
CPC ..... *G03G 15/2085* (2013.01); *G03G 15/2053* (2013.01); *G03G 2215/2032* (2013.01); *G03G 15/2028* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,782,231 | B2 * | 8/2004 | Fuma et al. | 399/328 |
| 2010/0080634 | A1 * | 4/2010 | Kimura | 399/329 |
| 2010/0239337 | A1 * | 9/2010 | Muramatsu et al. | 399/329 |

FOREIGN PATENT DOCUMENTS

JP 2010-139982 A 6/2010

* cited by examiner

*Primary Examiner* — Clayton E LaBalle
*Assistant Examiner* — Jas Sanghera
(74) *Attorney, Agent, or Firm* — Muncy, Geissler, Olds & Lowe, P.C.

(57) ABSTRACT

A fusion device for fusing a developer image on a medium includes a first belt member that has an endless shape, a first roller and a second roller arranged on an upstream side of the first roller in a medium carrying direction, and a pressure application part arranged on the other side of the medium carrying surface to face the first roller and the second roller. A roller radius (r2) of the second roller is smaller than a roller radius (r1) of the first roller, and the first belt member is configured to carry the medium in the medium carrying direction in a non-stretched state.

18 Claims, 15 Drawing Sheets

FUSION DEVICE AND IMAGE FORMING APPARATUS

CROSS REFERENCE TO RELATED APPLICATION

The present application is related to, claims priority from and incorporates by reference Japanese Patent Application No. 2012-196829, filed on Sep. 7, 2012.

TECHNICAL FIELD

The present invention relates to a fusion device used for electrographic image forming, and an image forming apparatus having the fusion device.

BACKGROUND

As a fusion device used for an image forming apparatus such as an electrographic photocopy machine, facsimile, printer, and multi-function peripheral, a fusion device using an endless belt has been known. For example, in JP Laid-Open Patent Application No. 2010-139982, a fusion device that is provided with two endless belts (first belt and second belt) that rotate around and move maintaining an oval shape and that is configured to form a free nip part between the endless belts is disclosed.

However, in the conventional fusion device, it is sometimes difficult to form a stable nip between the first belt and the second belt.

The present invention is for solving the above-described problem, and one of the objects of the present invention is to provide a fusion device capable of forming a stable nip and an image forming apparatus provided with the fusion device.

SUMMARY

A fusion device disclosed in the application for fusing a developer image on a medium includes a first belt member that has an endless shape, a first roller and a second roller arranged on an upstream side of the first roller in a medium carrying direction, and a pressure application part arranged on the other side of the medium carrying surface to face the first roller and the second roller. A roller radius (r2) of the second roller is smaller than a roller radius (r1) of the first roller, and the first belt member is configured to carry the medium in the medium carrying direction in a non-stretched state.

According to the present invention, a stable nip can be formed between the first belt member and the second belt member.

DETAILED DESCRIPTION OF EMBODIMENTS

First Embodiment

<Configuration of Image Forming Apparatus>

Figure 1:
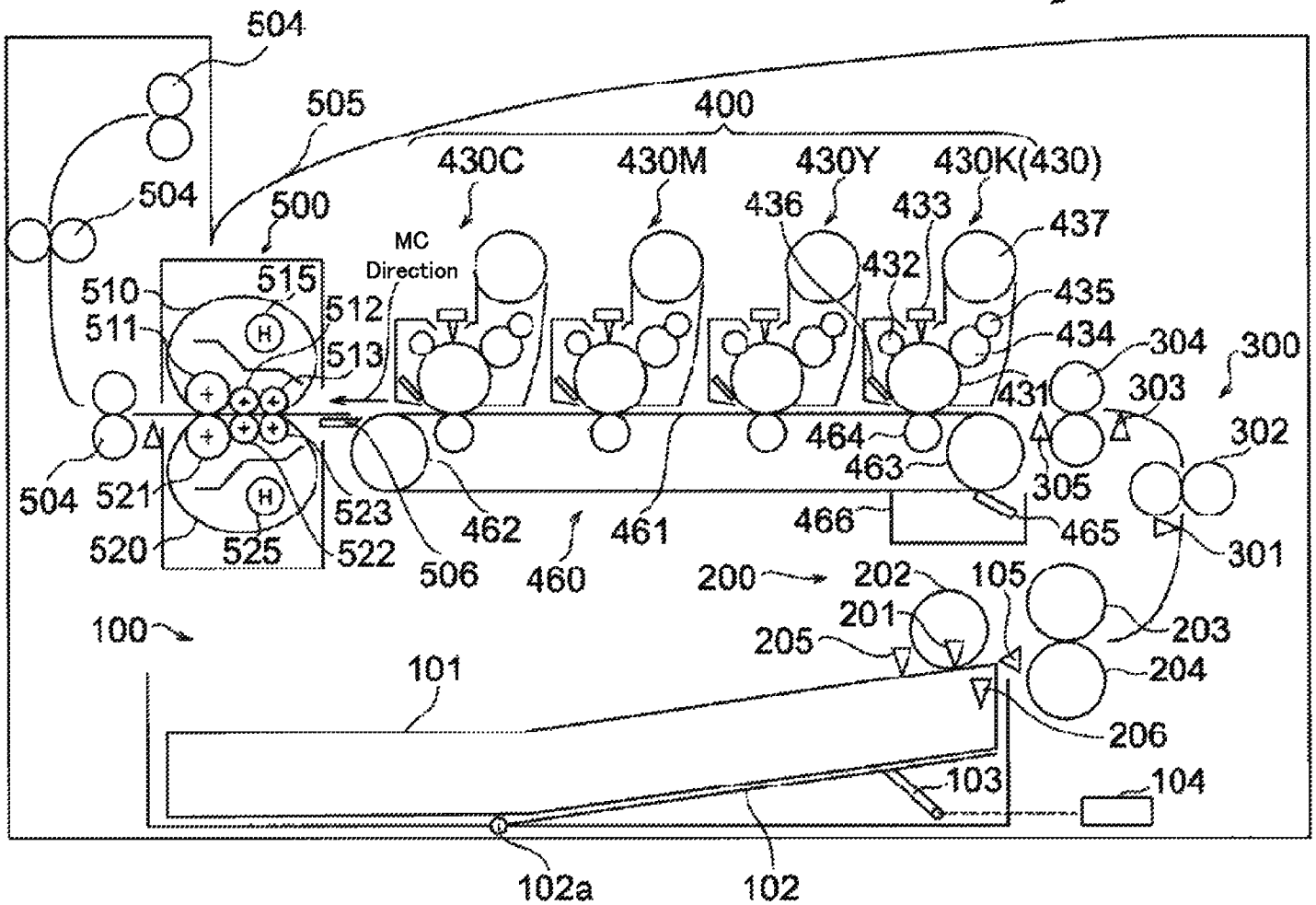
FIG. 1 is a view that shows a configuration of an image forming apparatus according to a first embodiment of the present invention.

First, an image forming apparatus 1 provided with a fusion device 500 according to a first embodiment of the present invention is explained. FIG. 1 is a view that shows a configuration of the image forming apparatus according to the first embodiment of the present invention.

The image forming apparatus 1 shown in FIG. 1 is a printer that forms a color image using an electrophotographic method, and is provided with a sheet supply tray (medium contain part) 100, a medium feeding part 200, a medium carrying part 300, an image forming part 400, and a fusion device (fusion part) 500.

The sheet supply tray 100 contains a medium 101 such as a print sheet, and is detachably equipped to a main part lower part of the image forming equipment 1. In the sheet supply tray 100, a medium stacking board 102 that stacks the medium 101 is revolvably provided around a supporting shaft 102*a* extending in a width direction of the medium 101.

On a lower side of the medium stacking board 102, a lift-up lever 103 that is revolvably supported by a revolving shaft 103*a* is provided. The revolving shaft 103*a* is configured to be capable of being connected to a motor 104 provided in a main body of the image forming apparatus 1. The sheet supply tray 100 is attached in the main body of the image forming apparatus 1. Thereby, the revolving shaft 103*a* is connected to the motor 104 and revolves the lift-up lever 103 using driving force of the motor 104. As a result, a tip end part of the lift-up lever 103 lifts the medium stacking board 102, and then the medium stacking board 102 revolves (moves upward and downward) around the supporting shaft 102*a*.

On the sheet supply tray 100, an upward-moving detection part 105 is provided. The upward-moving detection part 105 detects whether the medium 101 on the medium stacking board 102 has moved upward to a predetermined height. At the time when the medium 101 is detected by the upward-moving detection part 105, the rotation of the motor 104 stops and the upward-moving of the medium stacking board 102 stops. In the sheet supply tray 100, a guide member (not illustrated) as well that restricts stacking position of the medium 101 is provided. The guide member guides a rear end part (left end part in the figure) of the medium in a feeding direction and a side end part of the medium in a width direction.

Adjacent to the sheet supply tray 100, a medium feeding part 200 that feeds one sheet of the medium 101 contained in the sheet supply tray 100 at a time is provided. The medium feeding part 200 includes a pick-up roller 202 and a pair of rollers that is formed by a feeding roller 203 and a retard roller 204. The pick-up roller 202 is provided to contact and press an upper surface of the medium 101 stacking on the medium stacking board 102. The feeding roller 203 and the retard roller 204 are provided on the feeding side (right side in the figure) of the pick-up roller 202. One sheet of the medium 101 stacking on the medium stacking board 102 is fed at one time by the pick-up roller 202, the feeding roller 203, and the retard roller 204.

The medium feeding part 200 includes a medium absence detection part 205 and a medium remaining amount detection part 206. The medium absence detection part 205 detects the absence of the medium 101 on the medium stacking board 102. The medium remaining amount detection part 206 detects the remaining amount of the medium 101.

In the feeding side (upper right side in the figure) of the medium feeding part 200, a medium carrying part 300 that carries the fed medium 101 to the medium forming part 400 is provided. The medium carrying part 300 includes a pair of carrying rollers 302 and a pair of carrying rollers 304 along a carrying path of the medium 101.

Also, a medium sensor 301 for determining the driving timing of the pair of carrying rollers 302 is provided on the upstream side of the pair of carrying rollers 302 along the carrying path of the medium 101. The pair of carrying rollers 302 starts rotation with a predetermined time of delay after that the medium sensor 301 detects a passage. By delaying the timing of the rotation start as described above, the medium 101 is pressed to a contacting and pressing part of the pair of carrying rollers 302 and the incline of the medium 101 is corrected.

Furthermore, in the upstream side of the pair of carrying rollers 304, a medium sensor 303 for determining the driving timing of the pair of carrying rollers 304 is provided. The pair of carrying rollers 302 starts the rotation immediately after the passage detection by the medium sensor 303, and sends the medium 101 without stopping. In the downstream side of the pair of carrying rollers 304, a writing sensor 305 for determining an exposure timing of an exposure head 433, which will be described later, is provided.

The image forming part 400 includes toner image forming parts 430K, 430Y, 430M, and 430C as four developer image forming parts (process units) arrayed in a row from the right to the left along the carrying path of the medium 101, and a transfer part 460 that transfers a toner image formed by the toner image forming parts 430K, 430Y, 430M, and 430C to a surface of the medium 101.

The toner image forming parts 430K, 430Y, 430M, and 430C form a toner image respectively using black, yellow, magenta, and cyan toners (developers). Because the toner image forming parts 430K, 430Y, 430M, and 430C have a common configuration except for the toners to be used, the explanation of the toner image forming parts 430K, 430Y, 430M, and 430C is given using a general term "toner image forming part 430."

The toner image forming part 430 includes a photosensitive drum 431 as an image carrier that holds and carris a toner image. The photosensitive drum (OPC drum) 431 is a drum-shaped member in which a photosensitive layer (charge generation layer and charge transportation layer) is provided on a surface of a conductive base body and rotates clockwise in the figure.

Around the photosensitive drum 431, a charge roller 432, an exposure head 433, a development roller 434, and a cleaning member 436 are arranged. The charge roller 432 works as a charge member that evenly charges the surface of the photosensitive drum 431. The exposure head 433 works as an exposure device that irradiates the evenly-charged surface of the photosensitive drum 431 with light and forms an electrostatic latent image, and that includes, for example, a light-emitting diode (LED) array. The development roller 434 works as a developer carrier that develops an electrostatic latent image with toner. The cleaning member 436 cleans toner remaining on the surface of the photosensitive drum 431.

Also, in the toner image forming part 430, a supply roller 435 as a supply member that supplies toner to the development roller 434 and a toner supply part 437 (for example, a cartridge) as a developer supply part that supplies toner to the supply roller 435 are provided.

The transfer part 460 is provided with a transfer belt 461, a drive roller 462, and a tension roller 463. The transfer belt 461 having an endless shape suctions and holds the medium 101 using electrostatic force and carries the medium. The belt drive roller 462 drives the transfer belt. The tension roller 463 forms a pair with the belt drive roller 462 and adds tension to the transfer belt 461.

The transfer part 460 is provided with four transfer rollers 464 that are arranged to respectively face the toner image forming parts 430K, 430Y, 430M, and 430C in the photosensitive drums 431. In the transfer roller 464, transfer voltage is applied to transfer a toner image formed on the photosensitive drum 431 to the medium 101 using the Coulomb force.

The transfer part 460 is provided with a cleaning blade 465 and a toner box 466. The cleaning blade 465 works as a cleaning member that cleans toner adhered to the transfer belt 461. The toner box 466 works as a waste developer container that contains toner cleaned by the cleaning blade 465.

The toner image forming parts 430K, 430Y, 430M, and 430C and the transfer part 460 are synchronized to each other and controlled, and a toner image formed on the surface of the photosensitive drum 431 is transferred to the surface of the medium 101 that is electrostatically suctioned by the transfer belt 461.

Along the carrying path of the medium 101, a fusion device 500 is provided on the downstream side of the image forming part 400 (toner image forming part 430 and transfer part 460). The fusion device 500 applies heat and pressure to a toner image on the medium 101, melts the toner image, and fuses to the medium 101. A configuration of the fusion device 500 is explained later.

On the downstream side of the fusion device 500, an ejection roller group 504 for ejecting the medium 101 on which the fusion has been completed, and a stacker part 505 for stacking the ejected medium 101 are disposed along the carrying path of the medium 101.

Figure 2:
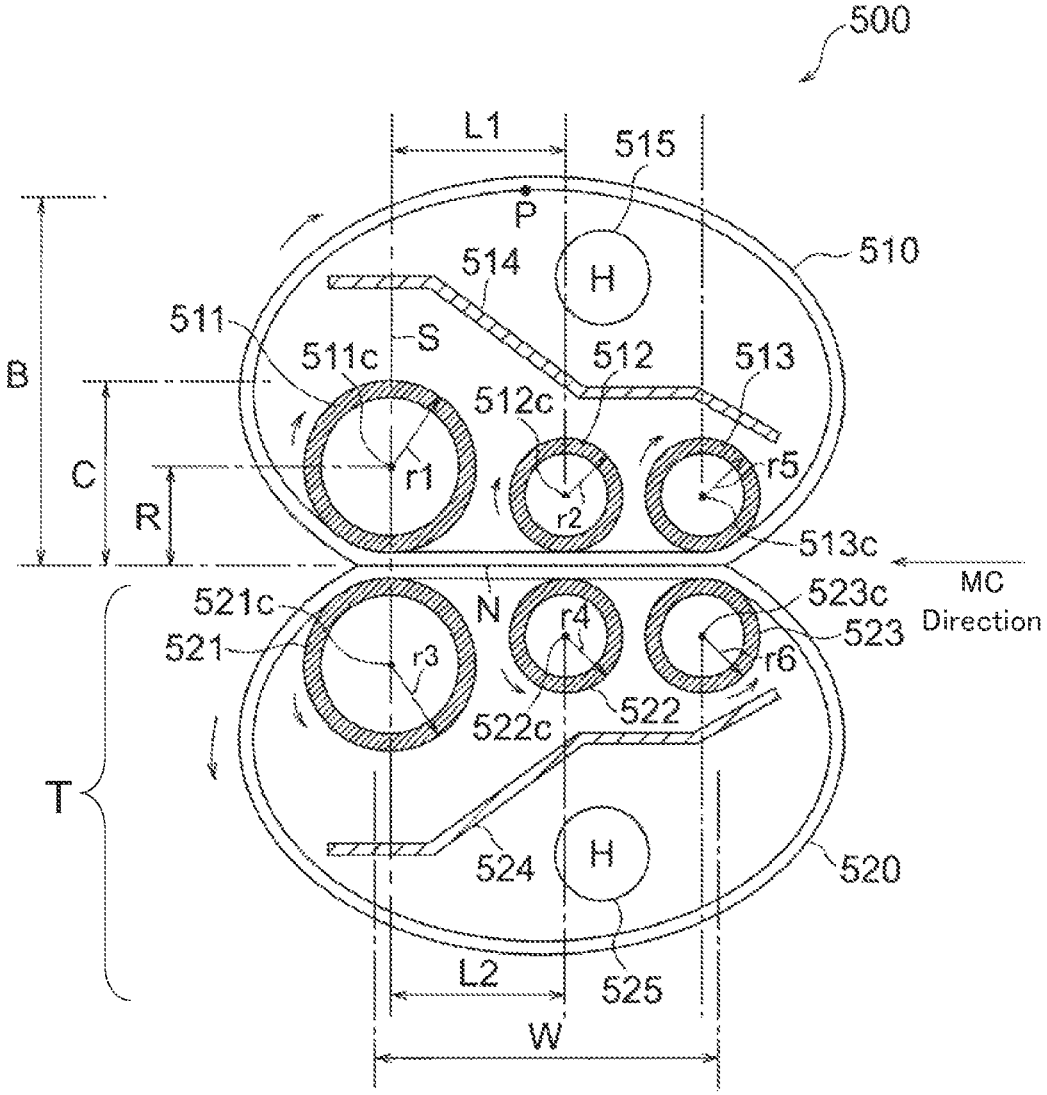
FIG. 2 is a sectional view that shows a configuration of a fusion device according to the first embodiment.
Figure 3:
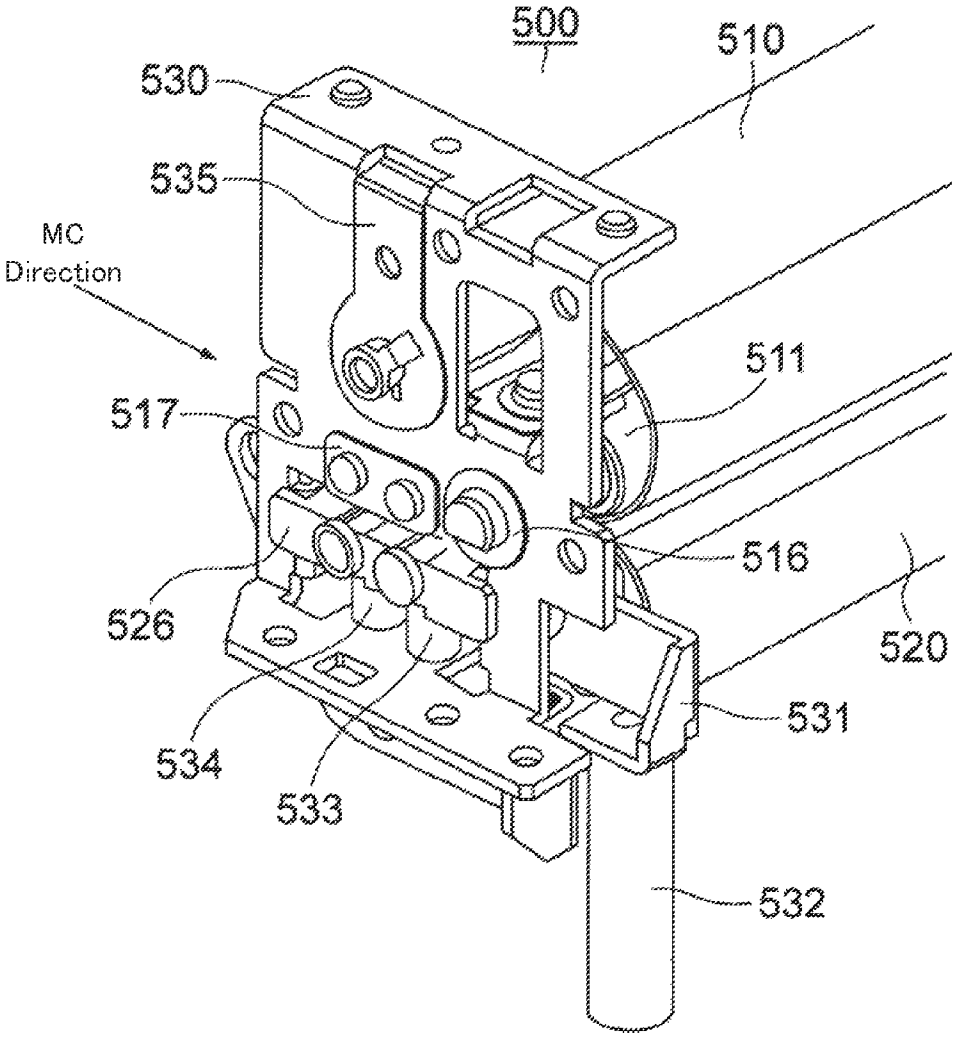
FIG. 3 is a perspective view that shows a main part of the fusion device according to the first embodiment.
Figure 4:
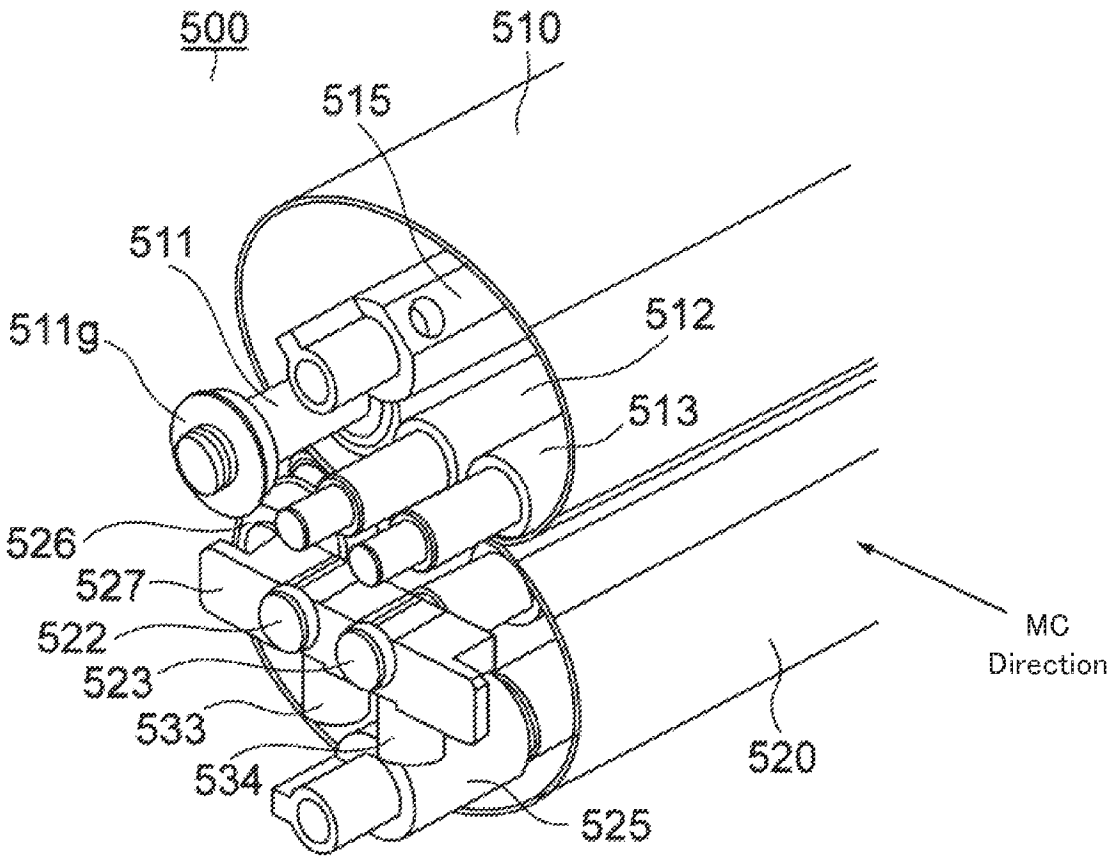
FIG. 4 is a perspective view that shows a part of the fusion device in an enlarged manner according to first embodiment.

Next, a configuration of the fusion device 500 according to a first embodiment is explained. FIG. 2 is a sectional view that shows a configuration of the fusion device 500 according to the first embodiment. FIG. 3 is a perspective view that shows a part of the fusion device 500. FIG. 4 is a perspective view that shows a part of the fusion device in an enlarged manner. In the figures, the carrying direction of the medium 101 passing through the fusion device 500 is shown by arrows.

As illustrated in FIG. 2, the fusion device 500 is provided with two endless shaped belts that are a fusion belt 510 as a first belt (fusion member) and a pressure application belt 520 as a second belt (pressure application part). A nip part N is formed between the fusion belt 510 and the pressure application belt 520 to fuse a not-yet-fused toner image to the medium 101.

In a region inside the fusion belt 510, a drive roller 511 as a first roller (drive member), an auxiliary roller 512 as a second roller, and a driven roller 513 as a fifth roller are arranged in this order from the most downstream side in the carrying direction of the medium 101 along the nip part N. The driven roller 513 is positioned on the most upstream side of the nip part N.

In a region inside the pressure application belt 520 which functions as the pressure application part T, a pressure application roller 521 as a third roller, an auxiliary pressure application roller 522 as a fourth roller, and a driven pressure application roller 523 as a sixth roller are arranged in this order from the most downstream side in the carrying direction of the medium 101 along the nip part N. The driven pressure application roller 523 is positioned on the most upstream side of the nip part N.

The drive roller 511, the auxiliary roller 512, and the driven roller 513 arranged in the region inside the fusion belt 510 face the pressure application roller 521, the auxiliary pressure application roller 522, and the driven pressure application roller 523 arranged in the region inside the pressure application belt 520

In the region inside the fusion belt 510, a heater 515 as a first heating member (heat source) is disposed. Similarly, inside the pressure application belt 520, a heater 525 as a second heating member (heat source) is disposed. As the heaters 515 and 525, halogen heaters are used herein; however, not limited to halogen heaters and conductive heating body and the like may be used.

Herein, an arrangement and a supporting structure of the rollers 511, 512, and 513, and the heater 515 arranged in the region inside the fusion belt 510 are explained.

The drive roller 511, the auxiliary roller 512, and the driven roller 513 are arranged such that the distances R from the nip part N to the center shafts (rotation center) of the rollers are shorter than the distance C from the nip part N to the center of the fusion belt 510. The definition of the distance C will be discussed later. The fusion belt 510 is not stretched by the drive roller 511, the auxiliary roller 512, or the driven roller 513, and is maintained in a tension-free state (free state or non-stretched state). In other way, the non-stretched state is defined as a state where, assuming that the pressure direction created by the pair of rollers 511 and 512 is vertical, there is no tension applied to the belt 510 in the horizontal direction. Also, it may be practical to define the non-stretched sate as a state where there is no tension in the medium carrying direction.

As illustrated in FIG. 3, the drive roller 511 is rotatably attached to brackets 530 as supporting members at both ends (only one end is illustrated in the figure) of a shaft of the drive roller 511 via bearings 516. The auxiliary roller 512 and the driven roller 513 are rotatably attached to the brackets 530 at both ends of shafts of the rollers via bearings 517. Note, the auxiliary roller 512 and the driven roller 513 are supported by the bearings 517 having a unit form, but the rollers may be respectively supported by separated bearings.

The heater 515 (FIG. 4) disposed in the region inside the fusion belt 510 is supported by a heater supporting part 535 disposed in the bracket 530 at both end parts of the heater 515. As illustrated in FIG. 2, the heater 515 is arranged at the upstream side of the drive roller 511 in the medium carrying direction and in a region between the auxiliary roller 512 and the driven roller 513 and the inner circumference surface of the fusion belt 510 (more specifically, a region between the nip part N of the auxiliary roller 512 and the driven roller 513 and a circumscription line of the opposite side, and the inner circumference surface of the fusion belt 510).

Also, between the heater 515 and the rollers 511, 512, and 513 inside the fusion belt 510, a reflection board 514 is provided. The reflection board 514 works as a reflection member that prevents direct radiation of heat from the heater 515 to the rollers. Note, the illustration of the reflection board 514 is omitted in FIG. 3. Instead of using the reflection board 514, for example, a heater provided with a reflection film (halogen heater having a reflection film and the like) may be used.

Next, an arrangement and supporting structure of the rollers 521, 522 and 524, and the heater 525 arranged inside the pressure application belt 520 are explained.

The pressure application roller 521, the auxiliary pressure application roller 522, and the driven pressure application roller 523 are arranged such that the distances from the nip part N to the center of the rollers are shorter than the distance from the nip part N to the center of the pressure application belt 520. As well as the fusion belt 510, the pressure application belt 520 is maintained in a tension-free state.

Figure 5:
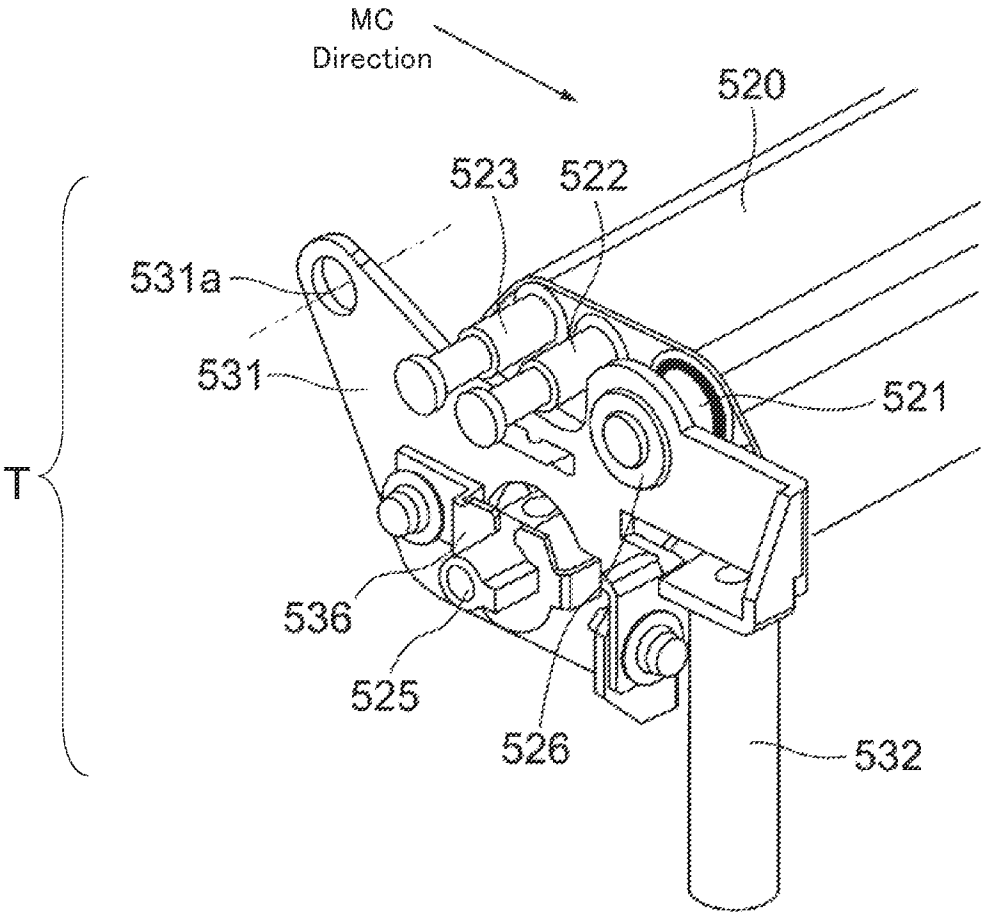
FIG. 5 is a perspective view that shows a pressure application part (T) of the fusion device according to the first embodiment.

FIG. 5 is a perspective view that shows a supporting structure of the pressure application roller 521, the auxiliary pressure application roller 522, and the driven pressure application roller 523. As illustrated in FIG. 5, the pressure application roller 521 is rotatably attached to pressure application roller levers 531 as rotatable supporting members at both ends (only one end is illustrated in the figure) of a shaft of the roller via bearings 526. The pressure application roller lever 531 is swingably attached to the bracket 530 (FIG. 3) with a swing shaft 531*a* (illustrated by a dot and dash line in the figure) as the center.

The pressure application roller lever 531 is biased by a spring 532 as a bias member such that the pressure application roller 521 swings in the direction of getting close to the drive roller 511. Thereby, the pressure application roller 521 is pressed to the drive roller 511 through the fusion belt 510 and the pressure application belt 520.

As illustrated in FIG. 4, the driven pressure application roller 523 and the auxiliary pressure application roller 522 are rotatably attached to common bearings 527 at both ends (only one ends are illustrated in the figure) of shafts of the rollers. The bearing 527 is supported by the bracket 530 so as to be able to slide in the directions of getting close to and getting distant from the above-described auxiliary roller 512 and the driven roller 513.

The auxiliary pressure application roller 522 is biased to the auxiliary roller 512 by a spring 533 as a bias member. The driven pressure application roller 523 is biased to the driven roller 513 by a spring 534 as a bias member. In other words, the auxiliary pressure application roller 522 and the driven pressure application roller 523 are respectively biased by different springs 533 and 534, and they are respectively pressed with pressure to the auxiliary roller 512 and the driven roller 513. Note, the auxiliary pressure application roller 522 and the driven pressure application roller 523 are supported by the bearings 527 having a unit form, but the rollers may be respectively supported by separated bearings.

The heater 525 disposed in the region inside the pressure application belt 520 is supported by a heater supporting part 536 (FIG. 5) disposed in the pressure application roller lever 531 at both end parts of the heater 525. As illustrated in FIG. 2, the heater 525 is arranged at the upstream side of the pressure application roller 521 in the medium carrying direction and in a region between the auxiliary pressure application roller 522 and the driven pressure application roller 523 and the inner circumference surface of the pressure application belt 520 (more specifically, a region between the nip part N of the auxiliary pressure application roller 522 and the driven pressure application roller 523 and a circumscription line of the opposite side, and the inner circumference surface of the pressure application belt 520).

Also, between the heater 525 and the rollers 521, 522, and 523 inside the pressure application belt 520, a reflection board 524 is provided. The reflection board 524 works as a reflection member that prevents direct radiation of heat from the heater 525 to the rollers. Note, the illustration of the reflection board 524 is omitted in FIG. 4. Instead of using the reflection board 524, for example, a heater provided with a reflection film (halogen heater having a reflection film and the like) may be used.

Because of the above-described configuration, the fusion belt 510 and the pressure application belt 520 are sandwiched by a first pair of rollers formed by the drive roller 511 and the pressure application roller 521, a second pair of rollers formed by the auxiliary roller 512 and the auxiliary pressure application roller 522 and a third pair of rollers formed by a driven roller 513 and the driven pressure application roller 523, and the nip part N is formed between the both belts 510 and 520.

The nip parts of the first, second and third pairs of rollers are positioned on the same straight line that is almost parallel to the carrying direction of the medium 101 in the side view (FIG. 2). This is for reducing the sliding resistance given to the fusion belt 510 and the pressure application belt 520 by arranging the nip parts N of the pairs of rollers on the same plane as the carrying surface of the medium 101. As a result, the carrying of the fusion belt 510 and the pressure application belt 520 can be stabilized. Herein, almost the same means that, when two straight lines inclined at ±5° from the end part on the most upstream side in the medium carrying direction of the nip part N1 formed by the first pair of rollers to the medium carrying surface are drawn, the nip part of the second pair of rollers and the nip part of the third pair of rollers are located within the region formed by the two straight lines and including the medium carrying surface.

On the other hand, in a case when a configuration that a pad is used for one or more of the pairs of rollers that form the nip part N is applied, the sliding resistance is generated by the sliding of the belt and pad. In the present embodiment, the fusion belt 510 and the pressure application belt 520 are carried by friction force generated between the drive roller 511 and the fusion belt 510 and between the pressure application belt 520 and the pressure application roller 521 as using the drive force of the drive roller 511. At this time, when the sliding resistance between the belt and the pad is generated, the sliding resistance works as carrying resistance so that the carrying by the fusion belt 510 and the pressure application belt 520 becomes unstable. Specifically, when the carrying is performed in a state where the fusion belt 510 and the pressure application belt 520 are not stretched, the effect of the sliding resistance is large.

In the above-described configuration, the range from the first pair of rollers formed by the drive roller 511 and the pressure application roller 521 to the third pair of rollers formed by the driven roller 513 and the driven pressure application roller 523 is a total nip part N. The length of the total nip part (total nip width) W is for example 20 mm. The total nip width W can be changed by shifting the position of the pair of rollers formed by the driven roller 513 and the driven pressure application roller 523 in the medium carrying direction. The total nip width W is defined by a length in the medium carrying direction shown in FIG. 2 from a contact point CP at which the fusion belt 510 comes to a contact to the pressure application belt 520 to a separating point SP at which the fusiton belt 510 takes apart from the pressure application belt 520.

Also, in the carrying direction of the medium 101, it is possible to change pressure distribution by increasing or decreasing the number (two pairs, herein) of the pairs of rollers arranged on the upstream side of the first pair of rollers formed by the drive roller 511 and the pressure application roller 521.

In the embodiment, the pressure application part is configured with the pressure application belt 520, the pressure application roller 521, the auxiliary pressure application roller 522, the driven pressure application roller 523, the bearings 526, 527, the springs 532, 533, 534, and the pressure application roller lever 531. However, the required function of the pressure application part T is to supply a predetermined pressure on the fusion belt 510. As long as the pressure is supplied, the structure is not necessarily limited to the above. The pressure application part T might be realized with a simple structure, as a pad or plate regardless of its material. In the embodiment, the pressure application part T is disposed outside the fusion belt 510. However, it may be disposed inside the fusion belt 510.

<Configurations of Rollers and Belts>

Next, the detail of the rollers and the belts are explained. In FIG. 2, the drive roller 511 is a hollow roller, and is formed by covering an outer circumference surface of an iron shaft (cored bar) with an elastic layer formed of for example silicone rubber and having anti-maturity property. Note, in the present embodiment, an iron shaft is used, but other metals such as for example aluminum may be used. A rubber hardness of the elastic layer is, for example, in the range of 75-85° in Asker C hardness. An outer diameter (2×r1) of the drive roller 511 is for example 12 mm, and a thickness of the elastic layer is for example 1 mm.

On one end part of the shaft of the drive roller 511, a gear 511*g* (FIG. 4) is attached. The gear 511*g* engages a gear attached to an output shaft of a fusion motor 129 (FIG. 9) disposed in the main body of the image forming apparatus 1. As a result, the rotation of the fusion motor 129 is transmitted to the drive roller 511 via the gear 511*g*, and the drive roller 511 rotates in the direction of carrying the medium 101.

Same as the drive roller 511, the pressure application roller 521 is a hollow roller, and is formed by covering an outer circumference surface of an iron shaft (cored bar) with an elastic layer formed of for example silicone rubber and having anti-maturity property. Note, in the present embodiment, an iron shaft is used, but other metals such as for example aluminum may be used. A rubber hardness of the elastic layer is, for example, in the range of 75-85° in Asker C hardness. An outer diameter (2×r3) of the pressure application roller 521 is for example 12 mm, and a thickness of the elastic layer is for example 1 mm.

The auxiliary roller 512, the driven roller 513, the auxiliary pressure application roller 522, and the driven pressure application roller 523 are made of small-diameter rollers having the outer diameter of, for example, 8 mm, and are formed by covering an outer circumference surface of an iron shaft (cored bar) with an elastic layer formed of for example silicone rubber and having anti-maturity property. A thickness of the elastic layer is for example 2 mm. A rubber hardness of the elastic layer is, for example, in the range of 75-85° in Asker C hardness. Note, in order to obtain an even pressure distribution, the elastic layer may be formed by a formed silicone rubber having the hardness of 50-60° in Asker C hardness, which is a low hardness, or a liquid silicone rubber having the hardness of 30-40° in Asker C hardness, which is a low hardness.

Figure 6:
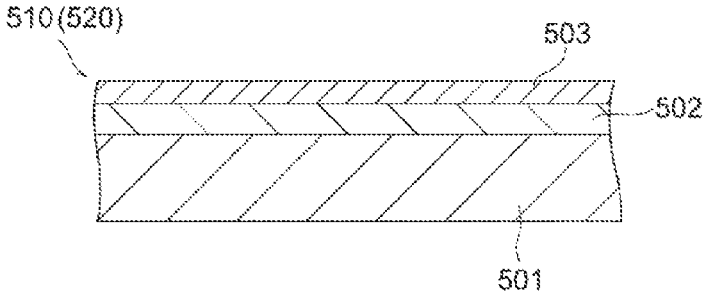
FIG. 6 is a view that shows a sectional configuration of a fusion belt and a pressure application belt according to the first embodiment.

FIG. 6 is a schematic view that shows a sectional configuration of the fusion belt 510 and the pressure application belt 520. As illustrated in FIG. 6, the fusion belt 510 and the pressure application belt 520 have a base material 501 in the inner circumference side, have the elastic layer 502 in the outer circumference side of the base material 501, and have a release layer 503 in the outer circumference side of the elastic layer 502. The elastic layer 502 and release layer 503 are defined as parts of an outer layer of the fusing belt 510.

The base material 501 is an endless belt made of a metal having elasticity, such as stainless steel (SUS). It is desired that the base material 501 has a thickness of about 40-70 μm and the belt itself has moderate rigidity and flexibility. The elastic layer 502 is a silicone rubber layer formed on the base material 501. Moreover, the release layer 503 is a fluorine system resin layer formed on the elastic layer 502, such as perfluoroalkoxy (PFA) and polytetrafluoroethylene (PTFE), and is formed by covering of a tube, or coating.

Note, the release layer 503 may be formed directly on the base material 501 without forming the elastic layer 502. Moreover, in order to increase the absorption efficiency of the radiant heat of the heaters 515 and 522, it is preferred that the inner circumference surfaces of the fusion belt 510 and the pressure application belt 520 are painted black.

Next, roller diameters of the above-described rollers are explained. A roller radius r2 of the auxiliary roller 512 that is adjacent to the upstream side of the medium carrying direction of the drive roller 511 is smaller than a roller radius r1 of the drive roller 511 (namely, $r2<r1$). Similarly, a roller radius r4 of the auxiliary pressure application roller 522 that is adjacent to the upstream side of the medium carrying direction of the pressure application roller 521 is smaller than a roller radius r3 of the pressure application roller 521 (namely, $r4<r3$). Note, a roller radius means the radius of a center part of the roller in a shaft direction (not a shaft end part but portion that contacts the belt).

Here, it is supposed that the roller radius r1 of the drive roller 511 and the roller radius r3 of the pressure application roller 521 are almost the same. Similarly, it is supposed that the roller radius r2 of the auxiliary roller 512 and the roller radius r4 of the auxiliary pressure application roller 522 are almost the same. In consideration of dimension errors due to processing accuracy and the like, almost the same means that a roller radius of one roller of a pair of rollers is within ±10% of a roller radius of the other roller. In other words, when a relation of $0.9\times r1\leq r3\leq 1.1\times r1$ for example is satisfied, the roller radius r1 and the roller radius r3 are almost the same.

A roller radium r5 of the driven roller 513 that is adjacent to the upstream side of the medium carrying direction of the auxiliary roller 512 is smaller than the roller radius r1 of the drive roller 511 ($r5<r1$). Similarly, a roller radium r6 of the driven pressure application roller 523 that is adjacent to the upstream side of the medium carrying direction of the auxiliary pressure application roller 522 is smaller than the roller radius r3 of the pressure application roller 521 ($r6<r3$).

It is supposed that the roller radius r2 of the auxiliary roller 512 and the roller radius r5 of the driven roller 513 are almost the same. In consideration of dimension errors due to processing accuracy and the like, almost the same means that a roller radius of one roller of a pair of rollers is within ±10% of a roller radius of the other roller. Namely, it is necessary to satisfy the relationship of $0.9\times r2\leq r5<1.1\times r2$.

Similarly, it is supposed that the roller radius r4 of the auxiliary pressure application roller 522 and the roller radius r6 of the driven pressure application roller 523 are almost the same. In consideration of dimension errors due to processing accuracy and the like, almost the same means that a roller radius of one roller of a pair of rollers is within ±10% of a roller radius of the other roller. Namely, it is necessary to satisfy the relationship of $0.9\times r4\leq r6<1.1\times r4$.

As illustrated in FIG. 2, when an shaft interval distance between a center shaft 511*c* of the drive roller 511 and the center shaft 512*c* of the auxiliary roller 512 in the medium carrying direction is set to L1, both the rollers 511 and 512 are arranged so that $2\times r1>L1$ is satisfied. Similarly, when an shaft interval distance between a center shaft 521*c* of the pressure application roller 521 and a center shaft 522*c* of the auxiliary pressure application roller 522 is set to L2, both the rollers 521 and 522 are arranged so that $2\times r3>L2$ is satisfied.

Moreover, when expansion of the drive roller 511 and the auxiliary roller 512, the expansion being generated by the temperature increase in the device, or the like are considered, in order to keep the drive roller 511 and the auxiliary roller 512 from contacting each other due to thermal expansion, it is desirable to satisfy $2\times r1\times 1.2>L1$. Similarly, in order to keep the pressure application roller 521 and the auxiliary pressure application roller 522 from contacting each other due to thermal expansion, it is desirable to satisfy $2\times r3\times 1.2>L2$.

It is supposed that the shaft interval distances L1 and L2 are almost the same in the present embodiment. Almost the same means that the relationship of $0.9\times L2\leq L1<1.1\times L2$ is satisfied, considering dimension errors due to processing accuracy and the like As described above, the pressure application roller 521 is pressed to the drive roller 511 through the fusion belt 510 and the pressure application belt 520. The center shaft (rotation center) 521*c* of the pressure application roller 521 and the center shaft 511*c* of the drive roller 511 are arranged on the same surface S that is almost perpendicular to the carrying direction of the medium 101. Herein, almost perpendicular means being in the range of 85°-95° with respect to the medium carrying direction.

Moreover, as described above, the auxiliary pressure application roller 522 is pressed to the auxiliary roller 512 through the fusion belt 510 and the pressure application belt 520. The center shaft 522*c* of the auxiliary pressure application roller 522 and the center shaft 512*c* of the auxiliary roller 512 are in the same plane that is almost perpendicular to the carrying direction of the medium 101 (that is, being within the range of 85°-95° with respect to the medium carrying direction).

Moreover, as described above, the driven pressure application roller 523 is pressed to the driven roller 513 through the fusion belt 510 and the pressure application belt 520. The center shaft 523*c* of the driven pressure application roller 523 and the center shaft 513*c* of the driven roller 513 are in the same plane that is almost perpendicular to the carrying direction of the medium 101 (that is, being within the range of 85°-95° with respect to the medium carrying direction).

When the drive roller 511 rotates by the drive force of the fusion motor 129, which is mentioned later, the pressure application roller 521, the fusion belt 510 and the pressure application belt 520 follow the rotation of the drive roller 511, and rotate. Moreover, the auxiliary roller 512, the driven roller 513, the auxiliary pressure application roller 522, and the driven pressure application roller 523 follow the rotation of the fusion belt 510 and the pressure application belt 520, and rotate.

By the first pair of rollers formed by the drive roller 511 and the pressure application roller 521, the second pair of rollers formed by the auxiliary roller 512 and the auxiliary pressure application roller 522 and the third pair of rollers formed by the driven roller 513 and the driven pressure application roller 523, the nip part N is formed between the fusion belt 510 and the pressure application belt 520. However, the fusion belt 510 and the pressure application belt 520 are in the state (free state) where they are not stretched. The nip part formed as described is called "free nip."

Note, regarding both the fusion belt 510 and the pressure application belt 520, a position of a belt inner circumference surface most distant from the nip part N is denoted by P (or internal farest point) and a distance (shortest distance) from the nip part N to the position P is denoted by B. In this case, a belt center is in the position B/2 distant from the nip part N in the direction perpendicular to the nip part N. The distance from the nip part N to the belt center is called a belt center distance C (FIG. 2). In the embodiment, the internal farest point P is denoted when the belt is not driving.

Figure 7A:
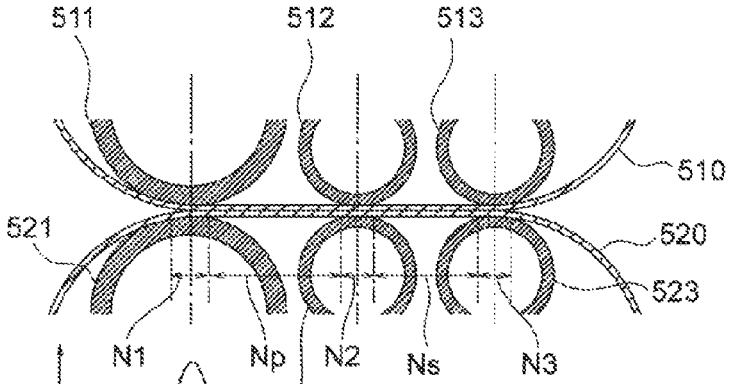
FIGS. 7A and 7B are graphs that show pressure distribution of a nip part of the fusion device according to the first embodiment.

FIG. 7A is a schematic view for explaining the pressure distribution of the nip part N. The pressure distribution is a distribution of the pressure (welding force) applied to the medium 101 sandwiched by the fusion belt 510 and the pressure application belt 520 in the nip part N. The horizontal axis indicates the position of the medium carrying direction, and a vertical axis indicates the pressure.

Figure 7B:
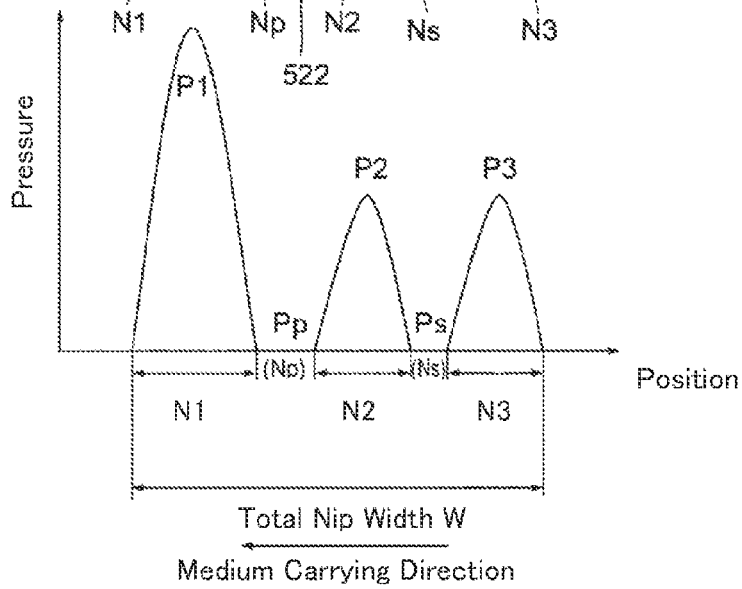

As illustrated in FIGS. 7A and 7B, the nip part formed by contact with the fusion belt 510 and the pressure application belt 520 at a position sandwiched by the first pair of rollers formed by the drive roller 511 and the pressure application roller 521 arranged in the most downstream side in the medium carrying direction is called a drive roller nip part N1. In this drive roller nip part N1, in order to obtain carrying force enough to carry the medium 101 and to obtain an optimal fusion image (toner image) without disorder, gap, unevenness, or the like, the pressure P1 is set to be the highest.

The nip part formed by contact with the fusion belt 510 and the pressure application belt 520 at a position sandwiched by the second pair of rollers formed by the auxiliary roller 512 and the auxiliary pressure application roller 522 arranged in almost the center in the medium carrying direction is called an auxiliary roller nip part N2. The pressure of the auxiliary roller nip part N2 is set to a pressure P2 with which the nip part is formed to be stable even during the rotation of the belts 510 and 520 as resisting the elastic force of the fusion belt 510 and the pressure application belt 520.

The nip part formed by contact with the fusion belt 510 and the pressure application belt 520 at a position sandwiched by the third pair of rollers formed by the driven roller 513 and the driven pressure application roller 523 arranged in the upstream side in the medium carrying direction is called a driven roller nip part N3. The pressure of the driven roller nip part N3 is set to a pressure P3 with which the nip part is formed to be stable even during the rotation of the belts 510 and 520 as resisting the rigidity of the fusion belt 510 and the pressure application belt 520.

In the present embodiment, the pressures P1, P2 and P3 may be set to satisfy the relationship of P1>P3≥P2. That is, because it is necessary to generate the carrying force for carrying the medium 101 in the drive roller nip part N1, the pressure P1 is set to be the highest. On the other hand, because it is not necessary to generate the carrying force in the auxiliary roller nip part N2 and the driven roller nip part N3, the pressures P2 and P3 are set to be smaller than the pressure P1 of the drive roller nip part N1.

The pressures P2 and P3 can be set to be the same (P2=P3). Or the pressure P2 of the auxiliary roller nip part N2 can be set to be smaller than the pressure P3 of the driven roller nip part N3 (P3>P2). The reason why the pressure P2 can be relatively small is that, while it is necessary to resist the rigidity of the base materials 501 of the fusion belt 510 and the pressure application belt 520 in the driven roller nip part N3, a horizontally extending portion is sandwiched by both the belts 510 and 520 in the auxiliary roller nip part N2.

Between the auxiliary roller nip part N2 and the driven roller nip part N3, a middle nip part Ns formed by the elastic force of the fusion belt 510 and the pressure application belt 520 is formed. Moreover, between the drive roller nip part N1 and the auxiliary roller nip part N2, a pre-nip part Np formed by the elastic force of the fusion belt 510 and the pressure application belt 520 is formed.

When the thicknesses of the base materials 501 of the fusion belt 510 and the pressure application belt 520 are for example 40 μm, which is thin, the rigidity of the base materials 501 is low. As a result, the nip parts N2 and N3 may turn to concaves, and the pressure may not be applied to the middle nip part Ns between them, in other words, so-called depressure may occur. Because depressure becomes a reason that causes a gap of a toner image at the time of fusing, it is not desirable.

Figure 8:
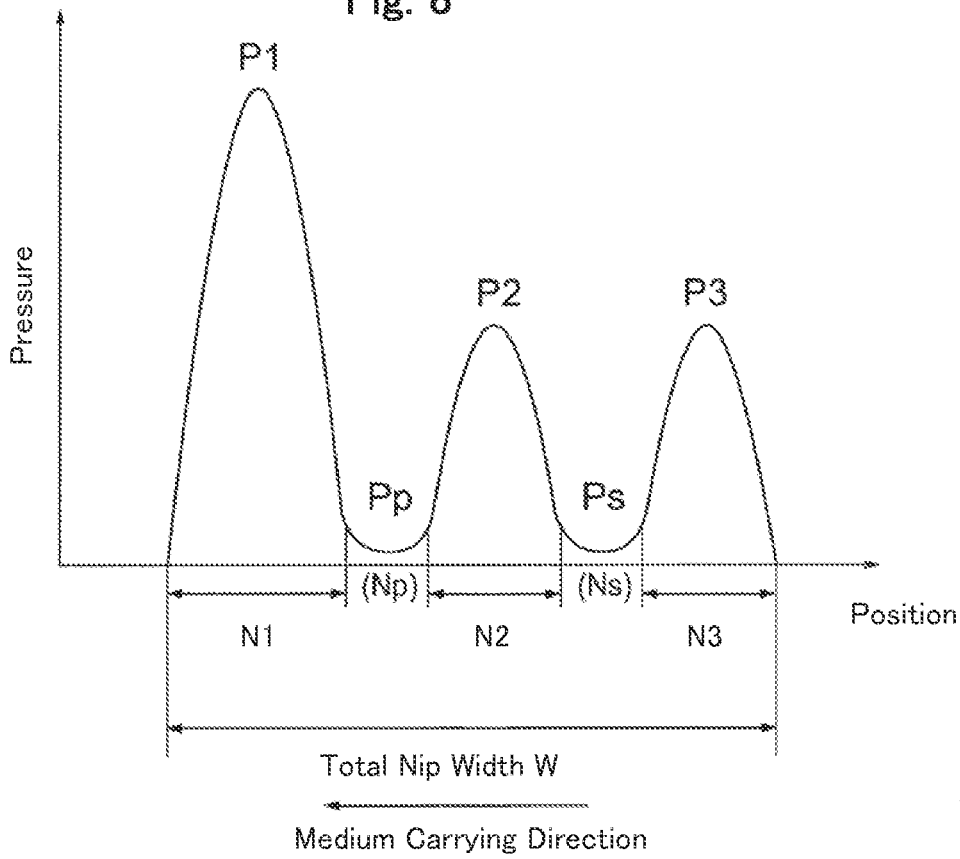
FIG. 8 is a graph that shows pressure distribution of the nip part of the fusion device according to the first embodiment.

On the other hand, when the thicknesses are for example 60 μm, which is thick, it is possible to secure a certain pressure Ps at the middle nip part Ns due to the elastic force of the base materials 501 as illustrated in FIG. 8. Similarly, also in the pre-nip part Np, a certain pressure Pp can be secured due to the elastic force of the base materials 501.

In the fusion device 500 as described above, the medium 101 passes through the driven roller nip part N3 (pressure P3), the middle nip part Ns (pressure Ps), the auxiliary roller nip part N2 (pressure P2), the pre-nip part Np (pressure Pp) and the drive roller nip part N1 (pressure P1) in this order. As a result, the medium 101 is pressurized and heated by the fusion belt 510 and the pressure application belt 520, and the toner image transferred on the medium 101 is fused to the medium 101.

<Control System of Image Forming Apparatus>

Figure 9:
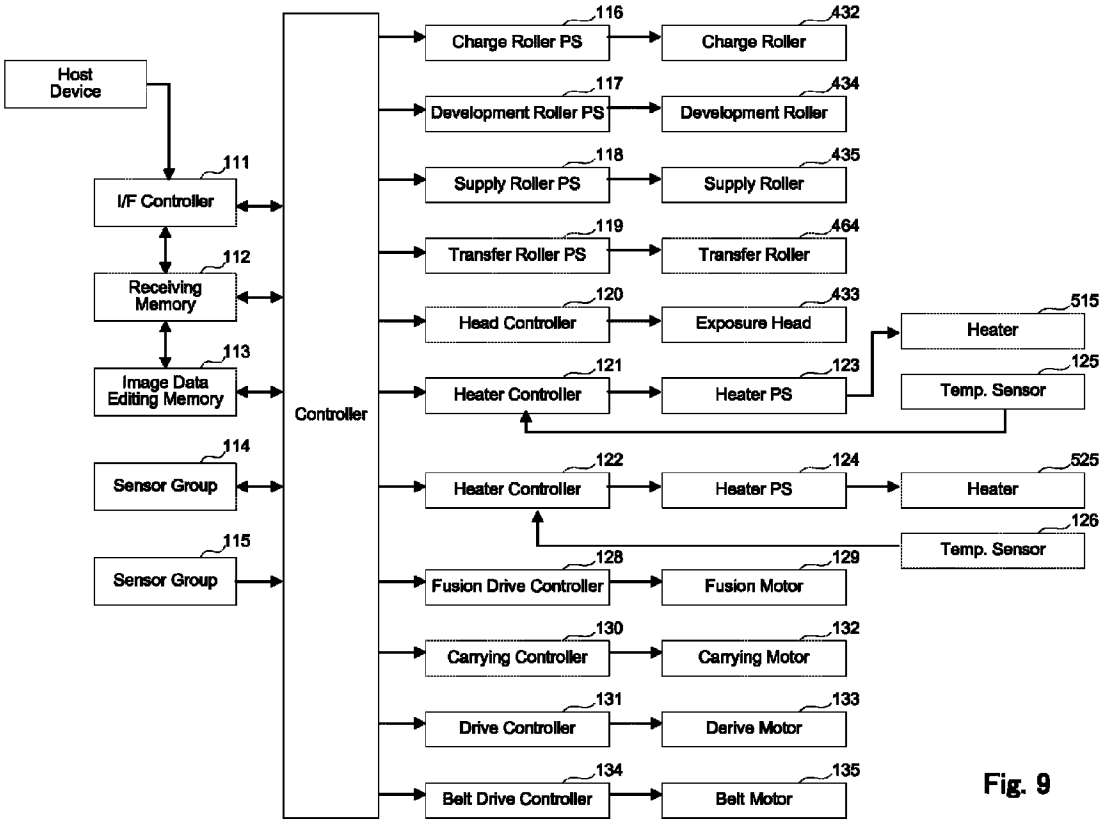
FIG. 9 is a block diagram of a control system of the image forming apparatus according to the first embodiment.

Next, a control system of the image forming apparatus 1 is explained. FIG. 9 is a block diagram that shows the control system of the image forming apparatus 1. A controller of the image forming apparatus 1 is provided with a controller 110, a interface (I/F) controller 111, a receiving memory 112, an image data edit memory 113, an operation part 114, a sensor group 115, a charge roller power source 116, a development roller power source 117, a supply roller power source 118, a transfer roller power source 119, a head controller 120, heater controllers 121 and 122, a fusion drive controller 128, a carrying controller 130, and a drive controller 131.

The controller 110 is configured including a microprocessor, a read only memory (ROM), a random access memory (RAM), an input-output port, a timer, and the like. The print controller 110 receives print data and control commands through the I/F controller 111 from the host device (not illustrated), and let the image forming apparatus 1 perform print operation.

The receiving memory 112 memorizes temporarily the print data input through the I/F controller 111 from the host device. While the image data edit memory 113 receives the print data memorized in the receiving memory 112, the image data edit memory 113 records image data formed by performing an edit process onto the print data that is image data.

The operation part 114 is provided with a display part (for example, LED) for displaying a state of the image forming apparatus 1 and an operation part (for example, switch) from which an operator inputs commands. The sensor group 115 includes various types of sensors for supervising the operation state of the image forming apparatus 1, such as a medium position sensor, temperature and humidity sensor, a concentration sensor, and the like.

The charge roller power source 116 applies charge voltage to the charge roller 432 according to the control by the controller 110 for charging evenly the surface of the photosensitive drum 431.

The development roller power source 117 applies development voltage to the development roller 434 according to the control by the controller 110 for developing an electrostatic latent image on the surface of the photosensitive drum 431.

The supply roller power source 118 applies supply voltage to the supply roller 435 according to the control by the controller 110 for supplying toner to the development roller 434.

The transfer roller power source 119 applies transfer voltage to the transfer roller 464 according to the control by the controller 110 for transferring a toner image on the sensitive drum 431 to the medium 101.

The head controller sends image data recorded in the image data edit memory 113 to the exposure head 433, and controls the light emission of the exposure head 433.

The heater controller (fusion controller) 121 includes a temperature control circuit, and supplies a predetermined current to the heater 515 (FIG. 2) from the heater power source 123 based on output signals of the temperature sensor (for example, thermistor) 125 disposed in the fusion device 500.

The heater controller (fusion controller) 122 includes a temperature control circuit, and supplies a predetermined current to the heater 525 (FIG. 2) from the heater power source 124 based on output signals of the temperature sensor (for example, thermistor) 126 disposed in the fusion device 500.

The fusion drive control part 128 rotates the fusion motor 129 to rotate the above-mentioned drive roller 511 (FIG. 2) in the fusion device 500.

The carrying control part 130 controls rotation of the carrying motor 132 for carrying the medium 101, and rotates the pick-up roller 202, the feeding roller 203, and pairs of carrying rollers 302 and 304, which are shown in FIG. 1. The belt drive control part 134 drives the transfer belt 461, so that rotation of the belt motor 135 is controlled to rotate the belt drive roller 462. Moreover, the ejection roller group 504 are rotated by the fusion motor 129 according to control of the fusion drive control part 128.

The drive controller 131 rotates the drive motor 133 for rotating the photosensitive drum 431, the developing roller 434, and the supply roller 435 and the like in the toner image forming part 430.

<Operation of Image Forming Apparatus>

Next, basic operations of the image forming apparatus 1 are explained. The controller 110 of the image forming device 1 starts an image forming (printing) operation upon the receipt of a print command and print data from the host device via the I/F controller 111. The controller 110 temporarily records the print data in the receiving memory 112, forms image data by performing an edit process on the recorded print data, and the record it in the image data edit memory 113.

The controller 110 lets the carrying controller 130 drives the carrying motor 132 again. Thereby, the pick-up roller 202 and the feeding roller 203 rotate, and one sheet of the medium 101 contained in the sheet cassette 100 is sent to the carrying path at one time. Furthermore, the pairs of the carrying rollers 302 and 304 carry the medium 101 to the image forming part 400 along the carrying path.

In the image forming part 400, the transfer belt 461 rotated by the belt drive roller 462 suctions and holds the medium 101 and carries the medium 101. The medium 101 passes through the toner image forming unit 430K, 430Y, 430M and 430C in this order.

The controller 110 forms respective color toner images in the toner image forming unit 430K, 430Y, 430M and 430C.

In other words, the controller 110 respectively applies charge voltage, development voltage, and supply voltage to the charge roller 432, the development roller 434, and the supply roller 435 in the toner image forming unit 430 from the charge roller power source 116, the development roller power source 117, and the supply roller power source 118.

The controller 110 lets the drive controller 131 rotate the drive motor 133 to rotate the photosensitive drum 431 again. Along with the rotation of the photosensitive drum 431, the charge roller 432, the development roller 434, and the supply roller 435 also rotate. The charge roller 432 charges evenly the surface of the photosensitive drum 431 with the charge voltage.

Further, the controller 110 controls light emission of the head control part 120 based on the image data recorded in the image data edit memory 113. The head controller 120 let the exposure head 433 expose the surface of the evenly charged photosensitive drum 431, and forms a staticelectricity latent image.

The staticelectricity latent image formed on the surface of the photosensitive drum 431 is developed by toner adhered to the development roller 434, and a toner image is formed on the surface of the photosensitive drum 431.

When the photosensitive drum 431 on which the toner image is formed rotates and the toner image approaches the surface of the transfer belt 461, the controller 110 applies transfer voltage to the transfer roller 464 from the transfer roller power source 119. Thereby, the toner image formed in the surface of the photo conductor drum 431 is transferred to the medium 101 on the transfer belt 461. Toner that has not been transferred to the transfer belt 461 is cleaned by the cleaning blade 435.

Thus, the respective color toner images formed in the toner image forming unit 430K, 430Y, 430M, and 430C sequentially are transferred to the transfer belt 461, and are overlapped to each other. The medium 101 to which the respective color toner images have been transferred is further carried by the transfer belt 461, is guided by a medium guide member 506, and reaches the fusion device 500.

In the fusion device 500, the heaters 515 and 525 of the fusion device 500 are heated by the heater controllers 121 and 122, and the temperature reaches a predetermined fusion temperature. The medium 101 carried to the fusion device 500 is heated while pressure is applied to the medium by the fusion belt 510 and the pressure application belt 520, and the toner image are fused to the medium 101. The details of fusion operation are mentioned later.

The medium 101 on which the toner image is fused is ejected by the ejection roller group 504 to the outside of the image forming apparatus 1, and is stacked on the stacker part 505. As a result, the formation of a color image onto the medium 101 is completed.

<Operation of Fusion Device>

Next, fusion operations in the fusion device 500 are explained as referring to FIG. 2. First, along with the start of image forming operation by the image forming apparatus 1, the rotation of the drive roller 511 starts in the fusion device 500. Specifically, rotation of the fusion motor 129 (FIG. 9) is transmitted to the drive roller 511 via the gear 511*g* (FIG. 4), and the drive roller 511 rotates in the direction of carrying the medium 101 (clockwise direction in FIG. 2). Along with the rotation of the drive roller 511, the fusion belt 510 rotates in the rotation direction of the drive roller 511 by friction force generated between the fusion belt 510 and the drive roller 511.

Upon the rotation of the fusion belt 510, the auxiliary roller 512 and the driven roller 513 follow the rotation of the fusion belt 510, and rotate in the direction of carrying the medium 101. Also, at the first nip part formed between the drive roller 511 and the pressure application roller 521, the rotation of the fusion belt 510 is transmitted to the pressure application belt 520. As a result, the pressure application belt 520 rotates in the direction of carrying the medium 101 at the same speed as the fusion belt 510.

The rotation of the pressure application belt 520 is transmitted to the auxiliary pressure application roller 522 and the driven pressure application roller 523, and the auxiliary pressure application roller 522 and the driven pressure application roller 523 rotate in the direction of carrying the medium 101.

The fusion belt 510 and the pressure application belt 520 are in a slack state (state in which the belts are not stretched) in regions except for the above-described nip part N. Because the base materials 501 (FIG. 6) of the fusion belt 510 and the pressure application belt 520 have rigidity, the fusion belt 510 and the pressure application belt 520 can rotate as maintaining the slack state of the regions except for the above-described nip part N.

Also, the heater 515 heats in response to a current supply from the heater power source 123 (FIG. 9), and heats the fusion belt 510 from its inside. The surface temperature of the heated fusion belt 510 is detected by the temperature sensor 125 and is input to the heater controller 121. The heater controller 121 controls a current supply to the heater 515 based on the detected surface temperature of the fusion belt 510, and maintains the surface temperature of the fusion belt 510 at a predetermined fusion temperature.

Similarly, the heater 525 heats in response to a current supply from the heater power source 124 (FIG. 9), and heats the pressure application belt 520 from its inside. The surface temperature of the heated pressure application belt 520 is detected by the temperature sensor 126 and is input to the heater controller 122. The heater controller 122 controls a current supply to the heater 525 based on the detected surface temperature of the pressure application belt 520, and maintains the surface temperature of the pressure application belt 520 at a predetermined fusion temperature. Note, not limited to the temperature control described here, a temperature control only on a fusion side (heater 515 side) may be performed.

Under a state where the fusion belt 510 and pressure application belt 520 are heated and the surface temperature is maintained at the fusion temperature, the medium 101 is introduced to the fusion device 500 via the medium guide member 506 (FIG. 1). The medium 101 is entered to the driven roller nip part N3 having the pressure P3 formed by contact with the fusion belt 510 and pressure application belt 520 at a position sandwiched by the driven roller 513 and the driven pressure application roller 523 (third pair of rollers), and pressurized and heated.

Furthermore, after the medium 101 passes through the driven roller nip part N3, the medium 101 passes through the middle nip part Ns secured by the elastic force of the fusion belt 510 and the pressure application belt 520, is entered to the auxiliary roller nip part N2 having the pressure P2 formed by contact with the fusion belt 510 and pressure application belt 520 at a position sandwiched by the auxiliary roller 512 and the auxiliary pressure application roller 522 (second pair of rollers), and pressurized and heated.

Furthermore, after the medium 101 passes through the auxiliary roller nip part N2, the medium 101 passes through the pre-nip part Np secured by the elastic force of the fusion belt 510 and the pressure application belt 520, is entered to the driven roller nip part N1 having the pressure P1 formed by contact with the fusion belt 510 and pressure application belt 520 at a position sandwiched by the driven roller 511 and the pressure application roller 521 (first pair of rollers), and pressurized and heated.

Thus, when the medium 101 passes through the nip parts N2, Ns, N3, Np, and N1, toner is sufficiently pressurized and heated and is fused to the surface of the medium 101. As a result, it is possible to prevent disorder, gap, unevenness and the like from being generated on the toner image, and stable fusion operation can be realized. That is, it is possible to secure the wide and stable NIP part N in the fusion device 500.

<Other Configuration Examples>

Figure 10:
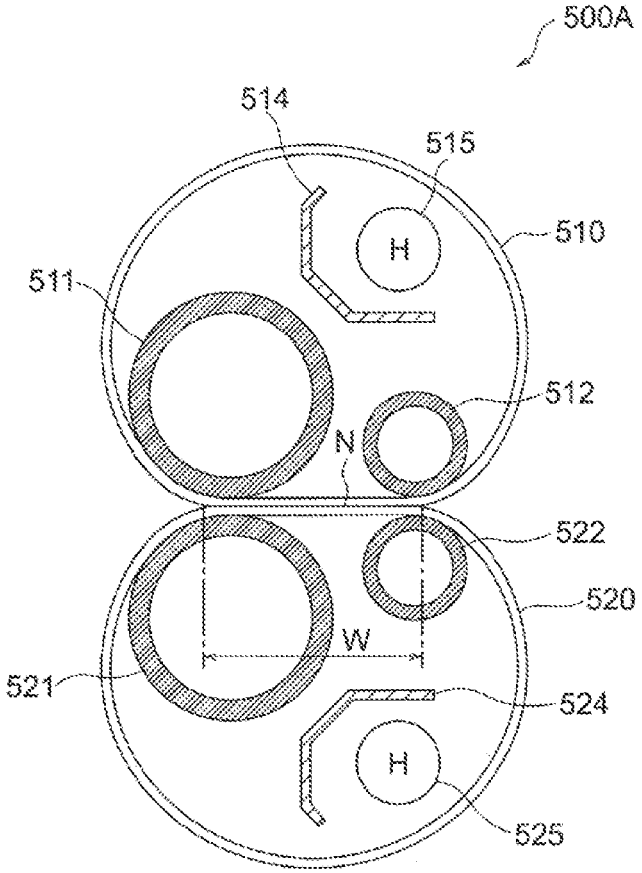
FIG. 10 is a view that shows another configuration example of the fusion device according to the first embodiment.
Figure 11:
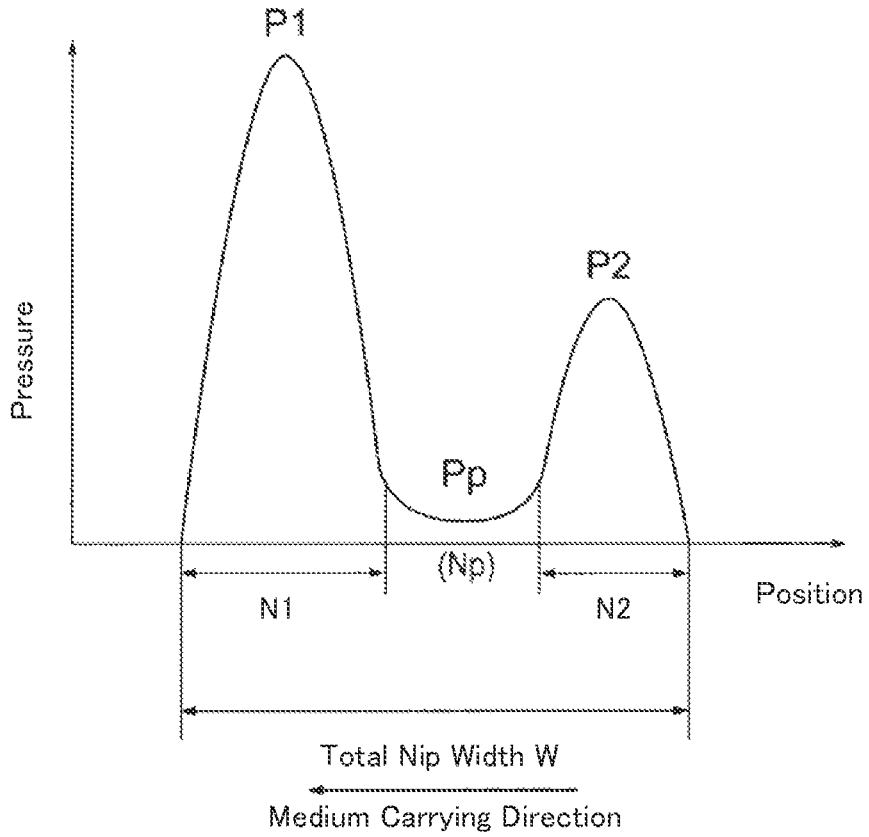
FIG. 11 is a graph that shows pressure distribution of a nip part of the fusion device shown in FIG. 10.

FIG. 10 is a view that shows another configuration example (fusion device 500A) of the fusion device 500. FIG. 11 is a graph that shows the pressure distribution of a nip part of the fusion device 500A of FIG. 10. In FIG. 11, the horizontal axis indicates the direction of the medium carrying direction, and the vertical axis shows the pressure.

The fusion device 500A shown in FIG. 10 is different from the above-described fusion device 500 (FIG. 4) in that the driven roller 513 and the driven pressure application roller 523 are not provided. In the fusion device 500A, the drive roller nip part N1 is formed between the drive roller 511 and the pressure application roller 521, and the auxiliary roller nip part N2 is formed between the auxiliary roller 512 and the auxiliary pressure application roller 522. Moreover, the pre-nip part Np is formed by the elastic force of the fusion belt 510 and the pressure application belt 520 between the drive roller nip part N1 and the auxiliary roller nip part N2. The total nip width W of the fusion device 500A is for example 16 mm, and is shorter than the total nip width W of the fusion device 500 of FIG. 4.

The number of the pairs of rollers, the fusion device 500A shown in FIG. 10 has one pair less than the fusion device 500 shown in FIG. 4. Therefore, as illustrated in FIG. 11, the width of the pre-nip part Np is relatively wide. However, even in this case, by adjusting the thicknesses or the materials of the base materials 501 of the fusion belt 510 and the pressure application belt 520, the pressure Pp with which the gap of the toner image is not generated can be secured. Therefore, also in the fusion device 500A illustrated in FIG. 10, the stable nip part N can be secured.

Figure 12:
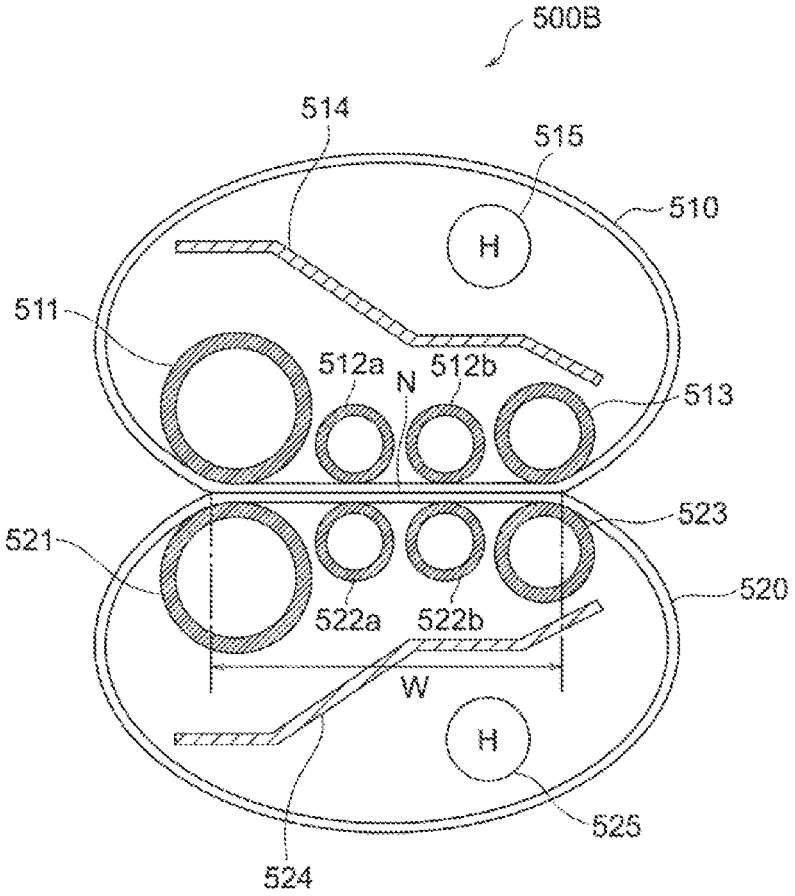
FIG. 12 is a view that shows other configuration example of the fusion device according to the first embodiment.
Figure 13:
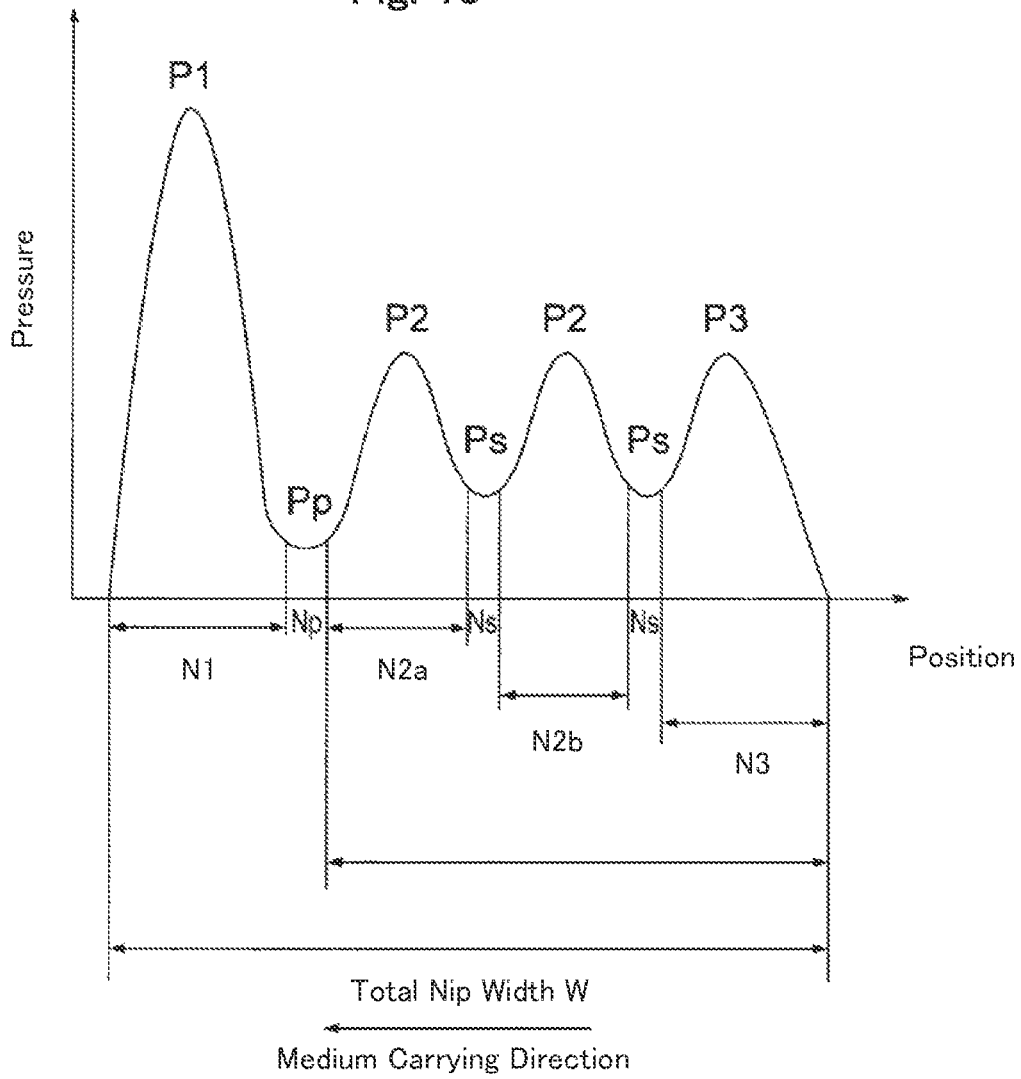
FIG. 13 is a graph that shows pressure distribution of a nip part of the fusion device shown in FIG. 12.

FIG. 12 is a view that shows the other configuration example (fusion device 500B) of the fusion device 500. FIG. 13 is a graph that shows the pressure distribution of a nip part of the fusion device 500B of FIG. 12. In FIG. 13, the horizontal axis indicates the position in the medium carrying direction, and the vertical axis shows the pressure.

The fusion device 500B illustrated in FIG. 12 is different from the above-described fusion device 500 (FIG. 4) in that a plurality (two rollers herein) of auxiliary rollers 512*a* and 512*b* and a plurality (two rollers herein) of auxiliary pressure application rollers 522*a* and 522*b* are provided.

In the fusion device 500B, as illustrated in FIG. 13, the drive roller nip part N1 is formed between the drive roller 511 and the pressure application roller 521, and the auxiliary roller nip part N2a is formed between the auxiliary roller 512*a* and the auxiliary pressure application roller 522*a*. Also, the auxiliary roller nip part N2b is formed between the auxiliary roller 512*b* and the auxiliary pressure application roller 522*b*, and the driven roller nip part N3 is formed between the driven roller 513 and the driven pressure application roller 523.

Also, the pre-nip part Np is formed by the elastic force of the fusion belt 510 and the pressure application belt 520 between the drive roller nip part N1 and the auxiliary roller nip part N2a. The middle nip part Ns is formed between the auxiliary roller nip parts N2a and N2b. The middle nip part Ns is formed between the auxiliary roller nip part N2b and the driven roller nip part N3.

Regarding the number of the pairs of rollers, the fusion device 500B shown in FIG. 12 has one pair more than the fusion device 500 shown in FIG. 4. Therefore, as illustrated in FIG. 13, the respective widths of the pre-nip part Np and the middle nip part N2 are narrow. Therefore, even in the case where the fusion belt 510 and the pressure application belt 520 are thin, the pressures Pp and Ps with which the gap of the toner image is not generated can be secured. Therefore, also in the fusion device 500B illustrated in FIG. 12, the stable nip part N can be secured.

<Effect of First Embodiment>

As described above, according to the first embodiment of the present invention, at least the drive roller 511 and the auxiliary roller 512 are formed inside the fusion belt 510, at least the pressure application roller 521 and the auxiliary pressure application roller 522 are formed inside the pressure application belt 520, the drive roller 511 and the pressure application roller 521 are face to each other, and the auxiliary roller 512 and the auxiliary pressure application roller 522 are face to each other. As a result, the stable and wide nip part N can be secured.

In order to secure the stable and wide nip part N, stable fusion operations even at a relatively low fusion temperature can be realized. Or, even when the speed for carrying the medium 101 is set to be fast, toner can be sufficiently heated. As a result, image forming speed (print speed) can be accelerated.

The nip part N is formed using the first pair of rollers formed by the drive roller 511 and the pressure application roller 521, the second pair of rollers formed by the auxiliary roller 512 and the auxiliary pressure application roller 522, and the third pair of rollers formed by the driven roller 513 and the driven pressure application roller 523, the nip width of the nip part N can be secured and its pressure (nip pressure) can be stabilized. By this, the medium 101 is sufficiently pressurized, and disorder, gap, unevenness, or the like on the toner image can be prevented from being generated.

Also, the pairs of rollers serve for the function of generating pressure to apply. Because the fusion belt 510 and the pressure application belt 520 rotate without receiving tension, it is possible to suppress the deterioration of the fusion belt 510 and the pressure application belt 520 due to slide friction. As a result, a preferred pressure to apply (nip pressure) can be stably obtained over a long period.

Furthermore, because the nip parts of the pairs of rollers are arrange on almost the same plane (in a straight line state when the medium carrying part is seen from the side perspective), toner images can be fused as load given to the medium 101 is suppressed to the least. Therefore, even when special medium such as thin paper, envelops, or the like is used, wrinkles can be prevented from being generated, and sufficient image quality can be secured.

Moreover, the roller radius r2 of the auxiliary roller 512 is set to be smaller than the roller radius r1 of the drive roller 511, so that the shaft interval distance L1 between both the rollers 511 and 512 can be shortened. That is, the drive roller 511 and the auxiliary roller 512 can be arranged such that the shaft interval distance L1 may become shorter than 2×r1 (the minimum shaft interval distance in the case when both of the roller radii of the drive roller 511 and the auxiliary roller 512 are set to be r1).

Similarly, the roller radius r4 of the auxiliary pressure application roller 522 is set to be smaller than the roller radius r3 of the pressure application roller 521, so that the shaft interval distance L2 between both of the rollers 521 and 522 can be shortened. That is, the pressure application roller 521 and the auxiliary pressure application roller 522 can be arranged such that the shaft interval distance L2 may become shorter than 2×r3 (the minimum shaft interval distance in the case when both of the roller radii of the pressure application roller 521 and the auxiliary pressure application roller 522 are set to be r3).

As described above, the drive roller 511 and the auxiliary roller 512 are arranged to be close to each other, and the pressure application roller 521 and the auxiliary pressure application roller 522 are arranged to be close to each other. Thereby, the pressure Pp of the pre-nip part Np on the upstream side of the drive rollers 511 and 521 can be stabilized. As a result, the medium 101 can be introduced into the drive roller nip part N1 between the drive roller 511 and the pressure application roller 521 in the stable state, and the quality of being fused of the toner image can be improved.

Thereby, even when the medium carrying speed is set to be fast, for example, the quality of fusion of a stable toner image can be realized. Furthermore, even when the reaction force that resists the nip part is generated when the medium 101 is introduced into the driven roller nip part N3 formed by the driven roller 513 and the driven pressure application roller 523, because the influence of the reaction force is less likely to transmit to the pre nip part Np, the pressure Pp of the pre-nip part Np can be stabilized.

Moreover, when the roller radius r5 of the driven roller 513 is set to be smaller than the roller radius r1 of the drive roller 511, the rotation load at the time of driving the drive roller 511 can be mitigated. Moreover, the same effect is obtained also when the roller radius r6 of the driven pressure application roller 523 is set to be smaller than the roller radius r3 of the pressure application roller 521.

Moreover, when the roller radius r1 of the drive roller 511 and the roller radius r3 of the pressure application roller 521 are set to be almost the same, and the roller radius r2 of the auxiliary roller 512, the roller radius r4 of the auxiliary pressure application roller 522, the roller radius r5 of the driven roller 513, and the roller radius r6 of the driven pressure application roller 523 are set to be almost the same, the heat capacities of the rollers can be set to be nearly even, and thereby, the heat fluctuation in the nip part N at the time of fusion operation can be suppressed.

Moreover, because the fusion belt 510 and the pressure application belt 520 are not stretched but form the free nip. Thereby, the pressure that acts on the medium 101 in the nip part N can be prevented from being unstable due to the reaction force generated when the belts 510 and 520 are stretched.

Moreover, a mounting space of the heater 515 is obtained as the nip width of the nip part N can be secured when the roller radius r2 of the auxiliary roller 512 and the roller radius r5 of the driven roller 513 are set to be smaller than the roller radius r1 of the drive roller 511, and the heater 515 is arranged at the upstream side of the drive roller 511 in the medium carrying direction and in a region formed by the nip part N of the auxiliary roller 512 and the driven roller 513, the circumscription line on the opposite side, and the inner circumference surface of the fusion belt 510. This contributes to the size reduction of the fusion device 500.

Moreover, when the second pair of rollers formed by the auxiliary roller 512 and the auxiliary pressure application roller 522 and the third pair of rollers formed by the driven roller 513 and the driven pressure application roller 523 are arranged at a narrower interval (small pitch), the stable pressure at the nip part N can be secured.

Second Embodiment

Figure 14:
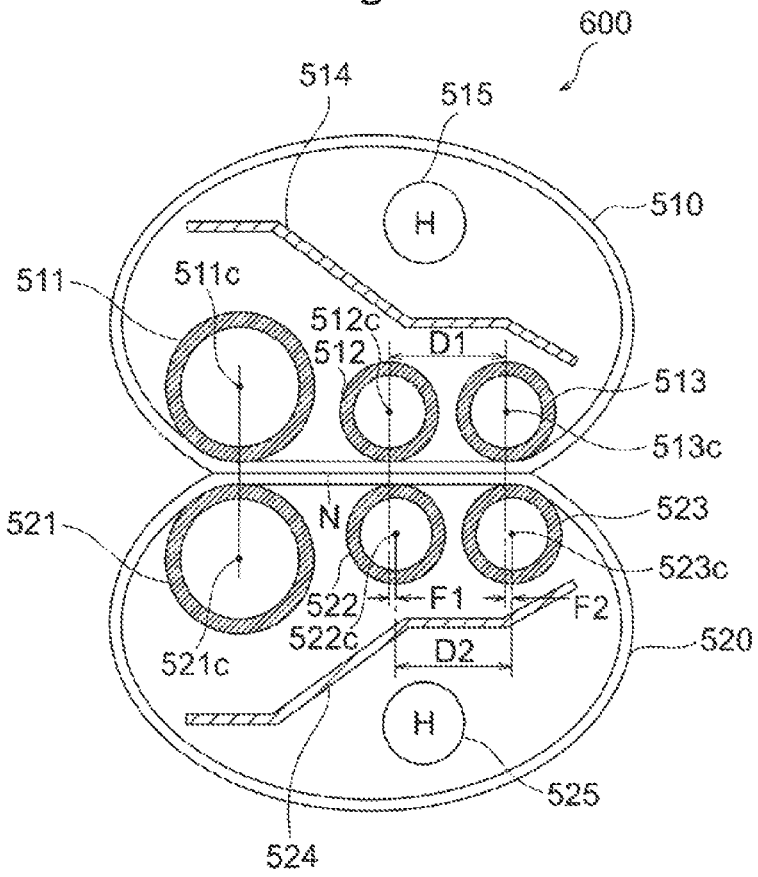
FIG. 14 is a sectional view that shows a configuration of a fusion device according to a second embodiment of the present invention.

Next, a second embodiment of the present invention is explained. FIG. 14 is a sectional view that shows a configuration of a main part of a fusion device 600 according to the second embodiment. Note, the same reference numbers are given to the configuration elements that are the same as the configuration elements according to the first embodiment.

In the second embodiment, the center shafts (rotation center) 512*c* and 522*c* of the auxiliary roller 512 and the auxiliary pressure application roller 522 are offset and arranged to face each other. An offset amount between the center shafts 512*c* and 522*c* of the auxiliary roller 512 and the auxiliary pressure application roller 522 is denoted by F1.

Similarly, the center shafts (rotation center) 513*c* and 523*c* of the driven roller 513 and the driven pressure application roller 523 are offset and arranged to face each other. An offset amount between the center shafts 513*c* and 523*c* of the driven roller 513 and the driven pressure application roller 523 is denoted by F2. Herein, the offset amounts F1 and F2 are almost the same. In consideration of dimension errors due to processing accuracy and the like, almost the same means a state where the relationship of $0.9\times F2 \leq F1 \leq 1.1\times F2$ is satisfied.

The center shafts 522*c* and 523*c* of the auxiliary pressure application roller 522 and the driven pressure application roller 523 are in the position where the center shafts 522*c* and 523*c* are offset to the center shafts 512*c* and 513*c* of the auxiliary roller 512 and the driven roller 513 toward the upstream side in the medium carrying direction. However, even when the center shafts 522*c* and 523*c* of the auxiliary pressure application roller 522 and the driven pressure application roller 523 are in the position where the center shafts 522*c* and 523*c* are offset to the center shafts 512*c* and 513*c* of the auxiliary roller 512 and the driven roller 513 toward the downstream side (left side in FIG. 14) in the medium carrying direction, the same effect is obtained.

The shaft interval distance D1 between the auxiliary roller 512 and the driven roller 513 and the shaft interval distance D2 between the auxiliary pressure application roller 522 and the driven pressure application roller 523 are almost the same. In consideration of dimension errors due to processing accuracy and the like, almost the same means a state where the relationship of $0.9\times D2 \leq D1 \leq 1.1\times D2$ is satisfied.

Moreover, as explained in the first embodiment, the auxiliary pressure application roller 522 and the driven pressure application roller 523 are respectively biased towards the auxiliary roller 512 and the driven roller 513 by the springs 533 and 534 (FIG. 3) as bias members.

Figure 15A:
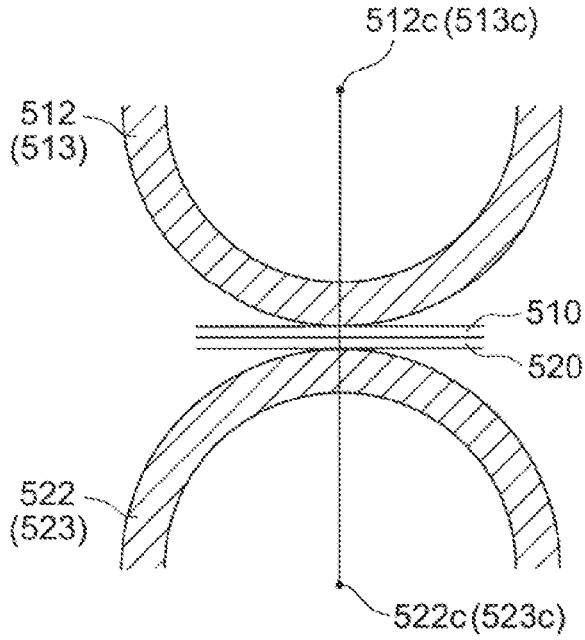
FIG. 15A is a schematically view that shows a state of a nip part in a case where center shafts of rollers are not offset and arranged.
Figure 15B:
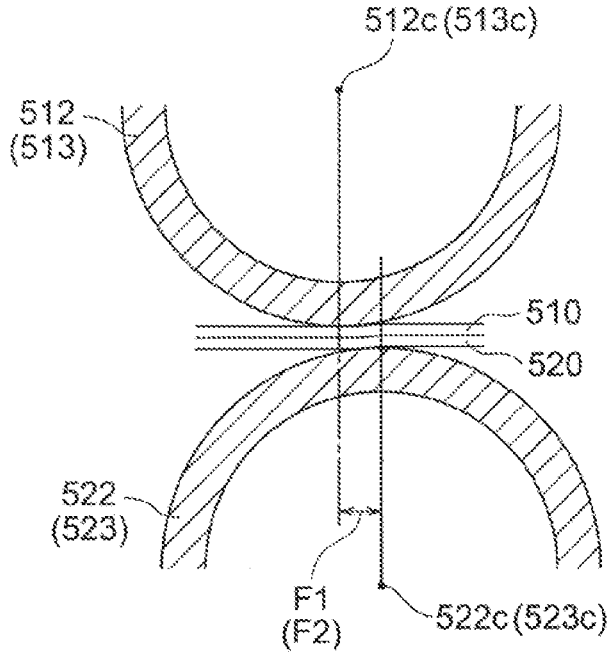
FIG. 15B is a schematic view that shows a state of a nip part in a case where center shafts of rollers are offset and arranged.

FIG. 15A is a schematic view that shows the nip part where the center shaft of the auxiliary roller 512 (driven roller 513) and the center shaft of the auxiliary pressure application roller 522 (driven pressure application roller 523) are not offset. FIG. 15B is a schematic view that shows a nip part where the center shaft of the auxiliary roller 512 (driven roller 513) and the center shaft of the auxiliary pressure application roller 522 (driven pressure application roller 523) are offset, and corresponds to the second embodiment.

As shown in FIG. 15B, when the center shaft 512*c* of the auxiliary roller 512 and the center shaft 522*c* of the auxiliary pressure application roller 522 are offset, the fusion belt 510 winds around and contacts the auxiliary roller 512 in the offset part (F1), and the pressure application belt 520 winds around and contacts the auxiliary pressure application roller 522. Thereby, sufficient pressure and a sufficient nip width are secured in the auxiliary roller nip part N2.

Similarly, when the center shaft 513*c* of the driven roller 513 and the center shaft 523*c* of the driven pressure application roller 523 are offset, the fusion belt 510 winds around and contacts the driven roller 513 in the offset part (F2), and the pressure application belt 520 winds around and contacts the driven pressure application roller 523. Thereby, sufficient pressure and a sufficient nip width are secured in the driven roller nip part N3.

Figure 16:
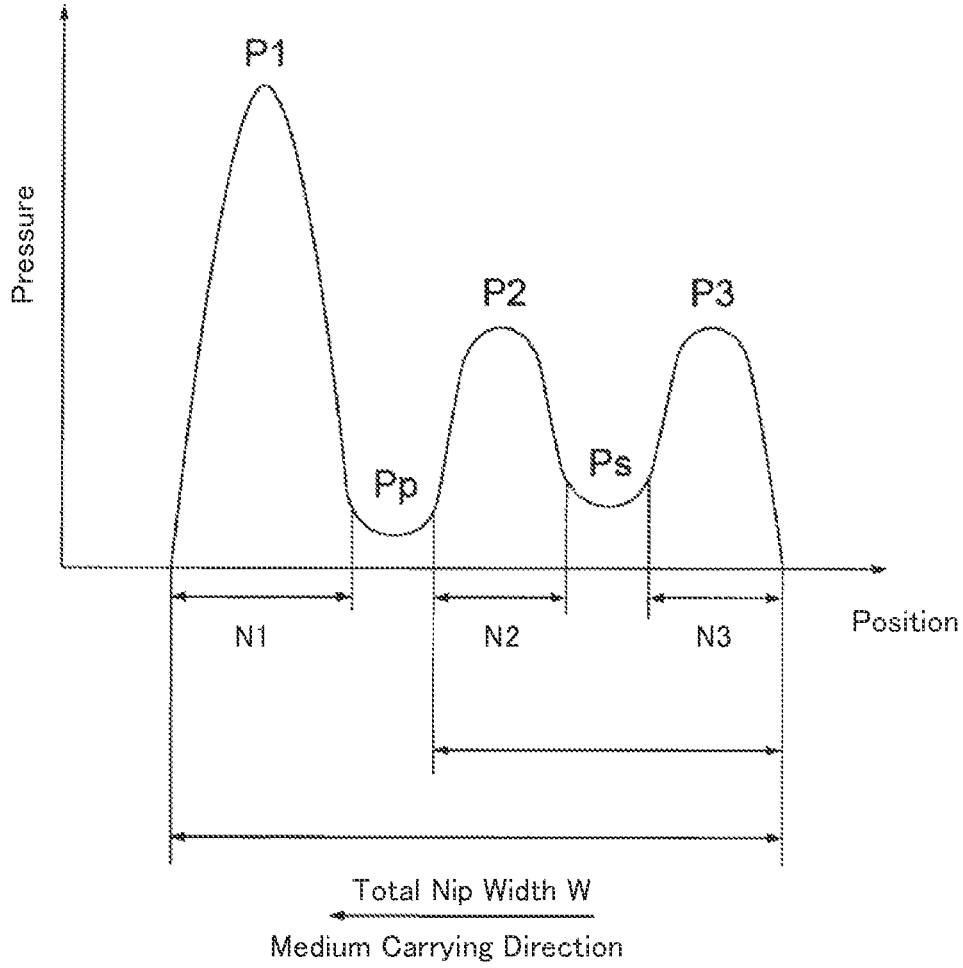
FIG. 16 is a graph that shows pressure distribution of a nip part of the fusion device according to the second embodiment.

FIG. 16 is a graph that shows the pressure distribution of a nip part of the fusion device 600 according to the second embodiment. The horizontal axis indicates the position in the medium carrying direction, and the vertical axis shows the pressure. Because the sufficient pressure and nip width are secured in the auxiliary roller nip part N2 and the driven roller nip part N3 as mentioned above, as shown in FIG. 16, in the middle nip part Ns between the auxiliary roller nip part N2 and the driven roller nip part N3, the pressure Ps higher than that of the first embodiment can be generated. By this, the generation of disorder, gap, unevenness, or the like on the toner image can be suppressed, and image quality can be improved.

Herein, the center shafts 522*c* and the 523*c* of the auxiliary pressure application roller 522 and the driven pressure application roller 523 are offset to the center shafts 512*c* and the 513*c* of the auxiliary roller 512 and the driven roller 513. However, not limited to this configuration, for example, a configuration that only the center shaft 522*c* of the auxiliary pressure application roller 522 is offset to the center shaft 512*c* of the auxiliary roller 512, or a configuration that only the center shaft 523*c* of the driven pressure application roller 523 is offset to the center shaft 513*c* of the driven roller 513 is applicable.

Note, the center shaft 511*c* of the drive roller 511 and the center shaft 521*c* of the pressure application roller 521 are not offset. This is because, when the center shafts 511*c* and 521*c* of the drive roller 511 and the pressure application roller 521 are offset, the medium 101 is not horizontally ejected when it is ejected from the drive roller nip part N1, and curl may be generated.

As explained above, in the second embodiment of the present invention, the center shafts 522*c* and 523*c* of the auxiliary pressure application roller 522 and the driven pressure application roller 523 are offset to the center shafts 512*c* and 513*c* of the auxiliary roller 512 and the driven roller 513. Thereby, in the offset part (F1), the fusion belt 510 winds around and contacts the auxiliary roller 512 and the pressure application belt 520 winds around and contacts the auxiliary pressure application roller 522. Similarly in the offset part (F2), the fusion belt 510 winds around and contacts the driven roller 513 and the pressure application belt 520 winds around and contact the driven pressure application roller 523. By this, sufficient pressure and nip width are obtained in the nip part, and the generation of disorder, gap, unevenness, or the like on the image can be suppressed. As a result, in addition to the effect explained in the first embodiment, image quality can be improved.

In the above described embodiments, examples that the present invention is applied to a fusion device for an electrographic printer are explained. However, the present invention can be used as a fusion device of an image forming apparatus using electrographic system such as a photocopy machine, a facsimile, a printer, a multi-function peripheral, and the like.

Also, in the above-described embodiments, as an example, a fusion device that fuses a color image is explained. However, the present invention can also be applied to a fusion device that fuses a monochrome (single color) image.

What is claimed is:

1. A fusion device for fusing a developer image on a medium by applying heat and pressure, the medium being carried along a medium carrying surface, comprising:

a first belt member that has an endless shape;

a first roller that is arranged on one side of the medium carrying surface:

a second roller that is arranged on an upstream side of the first roller in a medium carrying direction and on the same side of the medium carrying surface as the first roller; and a pressure application part that is arranged on the other side of the medium carrying surface to face the first roller and the second roller so that the first belt member is intervened by the pressure application part and the first and second rollers, and that supplies a pressure to the first roller and the second roller, wherein a roller radius (r2) of the second roller is smaller than a roller radius (r1) of the first roller, a first nip part (N1) is formed between the first roller and the pressure application part, a second nip part (N2) is formed between the second roller and the pressure application part, the first and second nip parts conveying the heat and pressure on the medium so that the developer image is fused, the first belt member is configured to carry the medium in the medium carrying direction in a non-stretched state, and where a distance in the medium carrying direction between center shafts of the first roller and the second roller is defined as a shaft interval distance (L1), the roller radius (r1) of the first roller and the shaft interval distance (L1) satisfy an equation below:

$$(2\times r1)\times 1.2>L1.$$

2. The fusion device according to claim 1, wherein the first and second rollers are disposed inside the first belt member.

3. The fusion device according to claim 2, wherein the pressure application part is provided with a second belt member that has an endless shape, a third roller that is arranged on an inner circumference surface side of the second belt member and that is arranged to face the first roller, a fourth roller that is arranged on an upstream side of the third roller in the medium carrying direction and that is arranged to face the second roller, a roller radius (r4) of the fourth roller is smaller than a roller radius (r3) of the third roller, the first nip part is formed by the first roller and the third roller, the second nip part is formed by the second roller and the fourth roller, the second belt member is configured to carry the medium in the medium carrying direction in a non-stretched state.

4. The fusion device according to claim 3, wherein the second belt member is configured with a base material which is an inner layer and an outer layer which is outside from the base material, the base material being metal so that the second belt member is driven and carries the medium in the non-stretched state in which the third roller or the fourth roller does not supply a tension to the second belt member.

5. The fusion device according to claim 4, wherein the base material of the second belt member has 40-70 μm thickness.

6. The fusion device according to claim 3, wherein where a distance in the medium carrying direction between center shafts of the third roller and the fourth roller is defined as a shaft interval distance (L2), the roller radius (r3) of the third roller and the shaft interval distance (L2) satisfy an equation below:

$$(2\times r3)\times 1.2>L2.$$

7. The fusion device according to claim 2, wherein the first belt member is configured with a base material which is an inner layer and an outer layer which is outside from the base material, the base material being metal so that the first belt member is driven and carries the medium in the non-stretched state in which the first roller or the second roller does not supply a tension to the first belt member.

8. The fusion device according to claim 7, wherein the base material of the first belt member has 40-70 μm thickness.

9. The fusion device according to claim 1, wherein the pressure application part is disposed inside the first belt member.

10. The fusion device according to claim 1, further comprising:

a fifth roller that is arranged on the upstream side of the second roller in the medium carrying direction and on the same side of the medium carrying surface; wherein a roller radius (r5) of the fifth roller is smaller than the roller radius (r1) of the first roller, a third nip part (N3) is formed between the fifth roller and the pressure application part, the third nip part conveying the heat and pressure on the medium.

11. The fusion device according to claim 10, wherein:

the pressure application part includes a second belt member that has an endless shape;

a third roller that is arranged on an inner circumference surface side of the second belt member and that is arranged to face the first roller, a fourth roller that is arranged on an upstream side of the third roller in the medium carrying direction and that is arranged to face the second roller, a sixth roller that is arranged on an inner circumference surface side of the second belt member and on an upstream side of the fourth roller in the medium carrying direction to face the fifth roller, a roller radius (r6) of the sixth roller is smaller than the roller radius (r3) of the third roller, a third nip part is formed by the fifth roller and the sixth roller, the third nip part conveying the heat and pressure on the medium.

12. The fusion device according to claim 1, further comprising:

a bias member that is configured to supply a bias force, wherein:

the pressure application part are movably mounted to the fusion device through the bias member so that a predetermined pressure is applied to the first roller and second roller.

13. The fusion device according to claim 1, wherein:

there is a low pressure region (Np) between the first nip part (N1) and the second nip part (N2), the less pressure region (Np) of which the pressure is generated only by a elastic character of the first belt member.

14. The fusion device according to claim 1, further comprising:

a fifth roller that is arranged on the upstream side of the second roller in the medium carrying direction and on the same side of the medium carrying surface; wherein a third nip part (N3) is formed between the fifth roller and the pressure application part, the third nip part conveying the heat and pressure on the medium.

15. The fusion device according to claim 14, wherein:

the pressure application part includes a second belt member that has an endless shape;

a third roller that is arranged on an inner circumference surface side of the second belt member and that is arranged to face the first roller, a fourth roller that is arranged on an upstream side of the third roller in the medium carrying direction and that is arranged to face the second roller, a sixth roller that is arranged on an inner circumference surface side of the second belt member and on an upstream side of the fourth roller in the medium carrying direction to face the fifth roller, a third nip part is formed by the fifth roller and the sixth roller, the third nip part conveying the heat and pressure on the medium.

16. A fusion device for fusing a developer image on a medium by applying heat and pressure, the medium being carried along a medium carrying surface, comprising:

a first belt member that has an endless shape;

a first roller that is arranged on one side of the medium carrying surface:

a second roller that is arranged on an upstream side of the first roller in a medium carrying direction and on the same side of the medium carrying surface as the first roller; and a pressure application part that is arranged on the other side of the medium carrying surface to face the first roller and the second roller so that the first belt member is intervened by the pressure application part and the first and second rollers, and that supplies a pressure to the first roller and the second roller, wherein a roller radius (r2) of the second roller is smaller than a roller radius (r1) of the first roller, a first nip part (N1) is formed between the first roller and the pressure application part, a second nip part (N2) is formed between the second roller and the pressure application part, the first and second nip parts conveying the heat and pressure on the medium so that the developer image is fused, the first belt member is configured to carry the medium in the medium carrying direction in a non-stretched state, and where a length in the medium carrying direction from a contact point to a separating point is defined a total nip width (W), the contact point (CP) at which the first belt member comes to a contact to the pressure application part, the separating point (SP) at which the first belt member takes apart from the pressure application part, the total nip width is within 16 mm to 20 mm.

17. The fusion device according to claim 16, further comprising:

a fifth roller that is arranged on the upstream side of the second roller in the medium carrying direction and on the same side of the medium carrying surface; wherein a third nip part (N3) is formed between the fifth roller and the pressure application part, the third nip part conveying the heat and pressure on the medium.

18. The fusion device according to claim 17, wherein:

the pressure application part includes a second belt member that has an endless shape;

a third roller that is arranged on an inner circumference surface side of the second belt member and that is arranged to face the first roller, a fourth roller that is arranged on an upstream side of the third roller in the medium carrying direction and that is arranged to face the second roller, a sixth roller that is arranged on an inner circumference surface side of the second belt member and on an upstream side of the fourth roller in the medium carrying direction to face the fifth roller, a third nip part is formed by the fifth roller and the sixth roller, the third nip part conveying the heat and pressure on the medium.

* * * * *